US006497290B1

(12) United States Patent
Misselbrook et al.

(10) Patent No.: US 6,497,290 B1
(45) **Date of Patent: *Dec. 24, 2002**

(54) METHOD AND APPARATUS USING COILED-IN-COILED TUBING

(76) Inventors: John G. Misselbrook, 7003 Amber Ct., Houston, TX (US) 77069; Spencer J. Fried, 783 McKenzie Lake Bay SE., Calgary, Alberta (CA), T2Z 2J2

( * ) Notice: Subject to any disclaimer, the term of this patent is extended or adjusted under 35 U.S.C. 154(b) by 0 days.

This patent is subject to a terminal disclaimer.

(21) Appl. No.: 09/142,887

(22) PCT Filed: Mar. 5, 1997

(86) PCT No.: PCT/US97/03563

§ 371 (c)(1),
(2), (4) Date: Feb. 1, 1999

(87) PCT Pub. No.: WO97/35093

PCT Pub. Date: Sep. 25, 1997

Related U.S. Application Data

(63) Continuation-in-part of application No. PCT/US95/10007, filed on Jul. 25, 1995, and a continuation of application No. 08/564,355, filed on Mar. 19, 1996, now Pat. No. 5,638,904.

(51) Int. Cl.[7] ..... E21B 19/08
(52) U.S. Cl. ..... 166/384; 166/77.2
(58) Field of Search ..... 166/384, 385, 166/379, 380, 77.2, 77.3

(56) References Cited

U.S. PATENT DOCUMENTS

| | | | | |
|---|---|---|---|---|
| 4,744,420 A | | 5/1988 | Patterson et al. | 166/312 |
| 5,033,545 A | | 7/1991 | Sudol | 166/312 |
| 5,086,842 A | | 2/1992 | Cholet | 166/312 |
| 5,178,223 A | | 1/1993 | Smet | |
| 5,236,036 A | * | 8/1993 | Ungemach et al. | 166/77 |
| 5,285,204 A | | 2/1994 | Sas-Jaworsky | |
| 5,348,097 A | | 9/1994 | Giannesini | 166/385 |
| 5,435,395 A | | 7/1995 | Connell | 166/384 |
| 5,638,904 A | | 6/1997 | Misselbrook et al. | 166/384 |
| 6,015,015 A | * | 1/2000 | Luft et al. | 166/384 |

FOREIGN PATENT DOCUMENTS

| | | |
|---|---|---|
| CA | 1325969 | 1/1994 |
| WO | WO 997/05361 | 2/1997 |

OTHER PUBLICATIONS

Halliburton; New Management Tool for Multi–Layered Reservoirs Perforates and Tests Scattered Pay Zones in One Trip.
Nowsco; Underbalanced Drilling.
Nowsco/Downhole Systems: "Test, Treat, Test System Using a Concentric Coiled Tubing/DST Package": Huyer, Fried & Sask paper to be presented Jun. 12–12, 1996 at Annual Meeting of Petroleum Society in Calgary, Alberta.
PCT/US97/03563 International Search report Jun. 2, 1997.
PCT/US97/03563 International Examination Report Jan. 5, 1998.

* cited by examiner

*Primary Examiner*—William Neuder

(57) ABSTRACT

Method and apparatus for performing well operations, such as measuring or forming or testing or treating or the like, and combinations of the above operations, including the use of coiled-in-coiled tubing (CCT) connected to a bottomhole assembly package (BHA), such that the assembly is in communication with both fluid conduits (80 and 82) defined by the coiled-in-coiled tubing.

44 Claims, 11 Drawing Sheets

FIG. 7
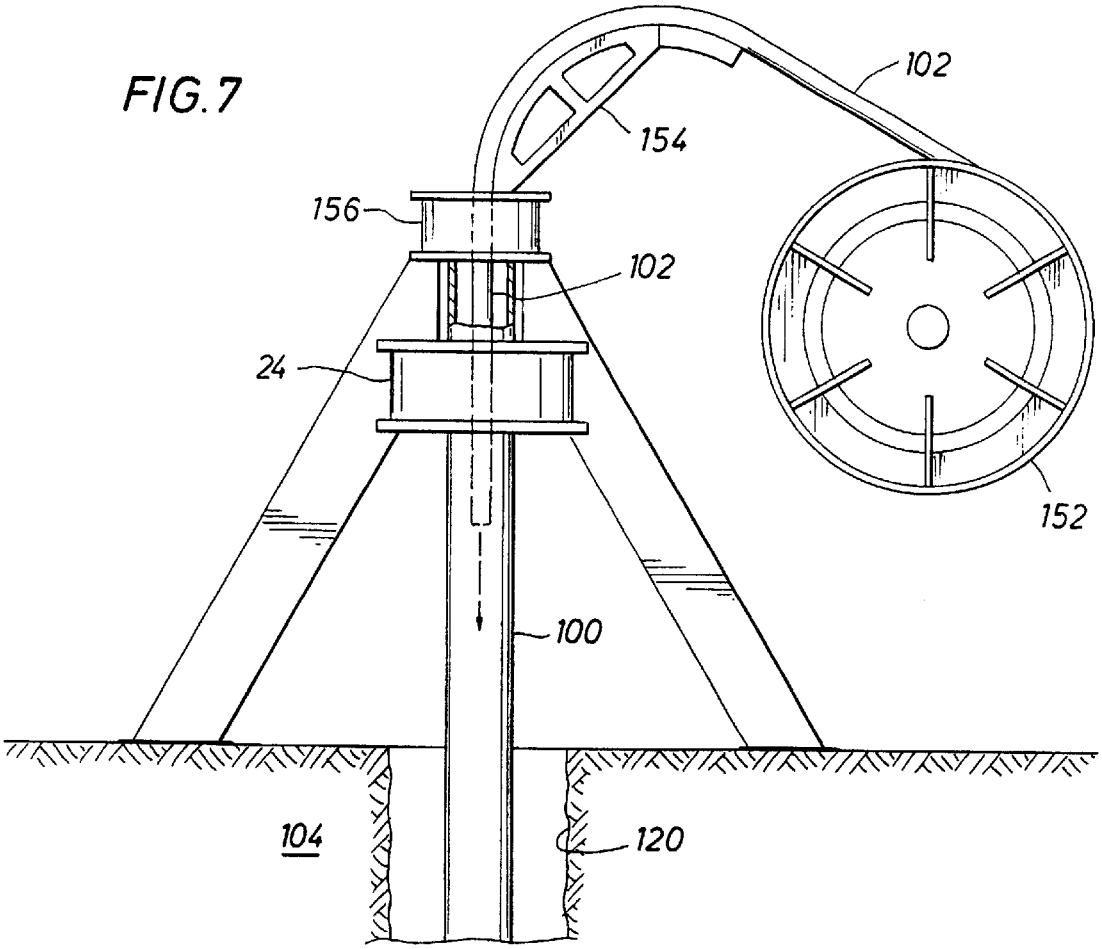
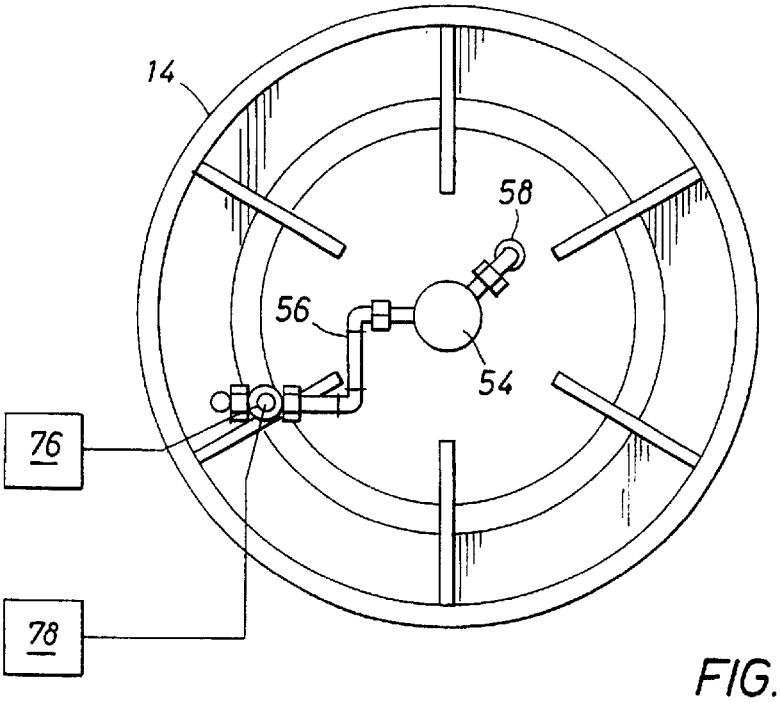
FIG. 2B

FIG. 8D
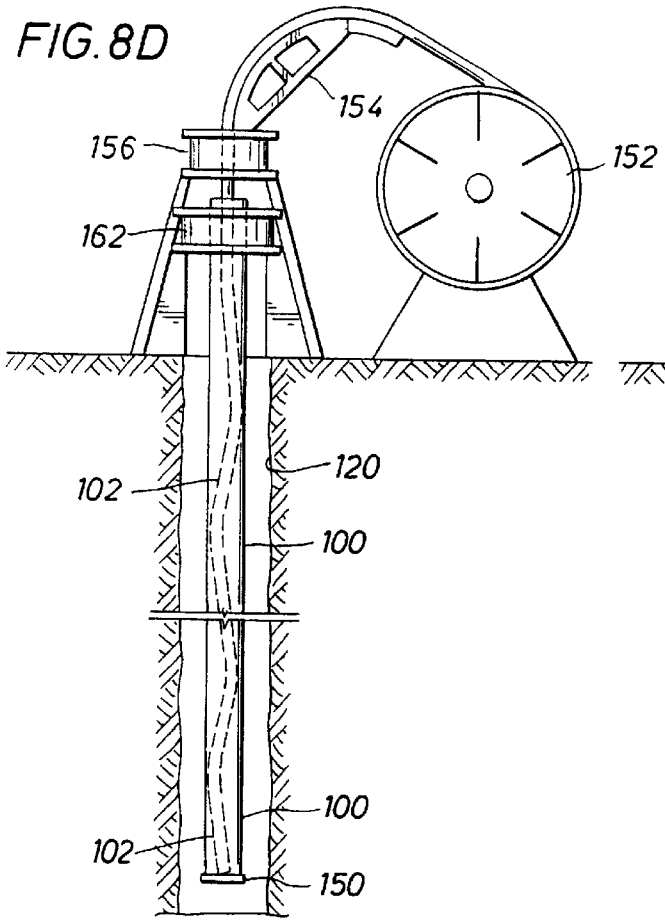
FIG. 8E
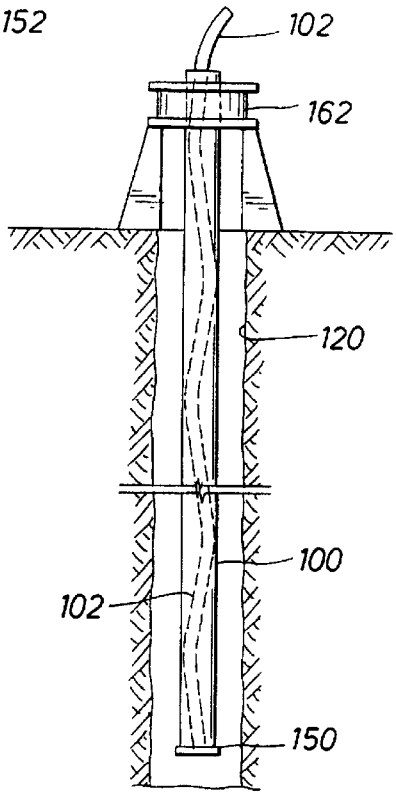
FIG. 8F
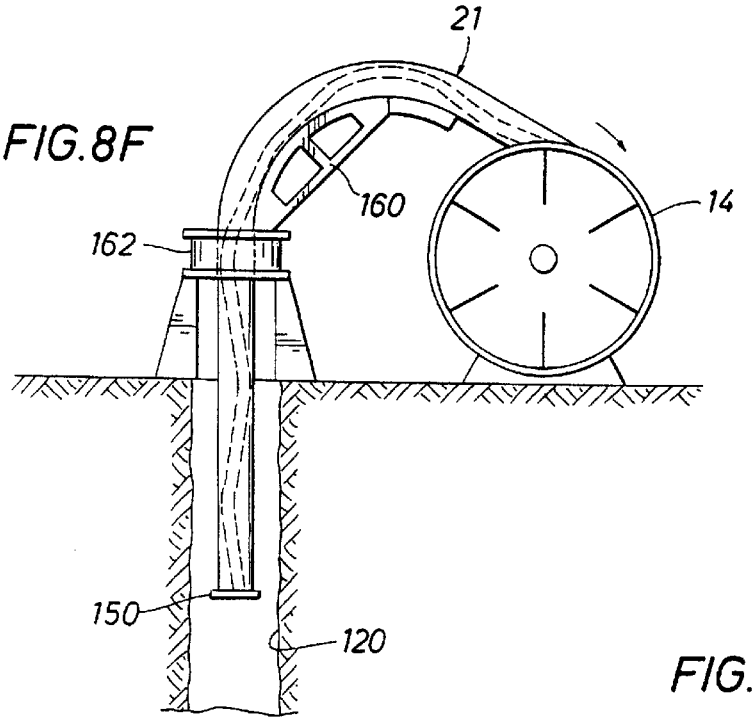
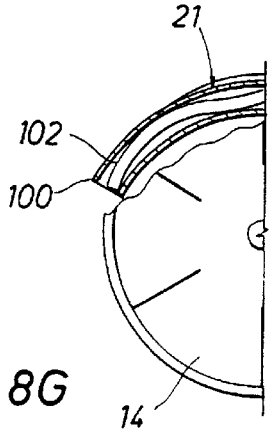
FIG. 8G

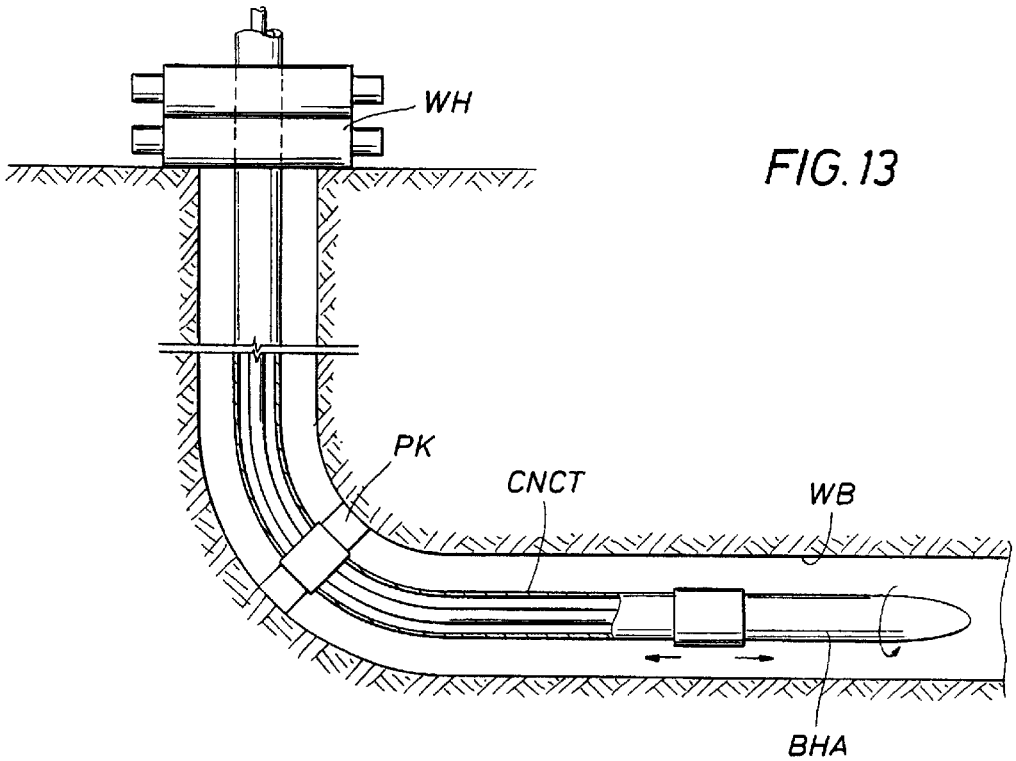
FIG. 13
FIG. 14
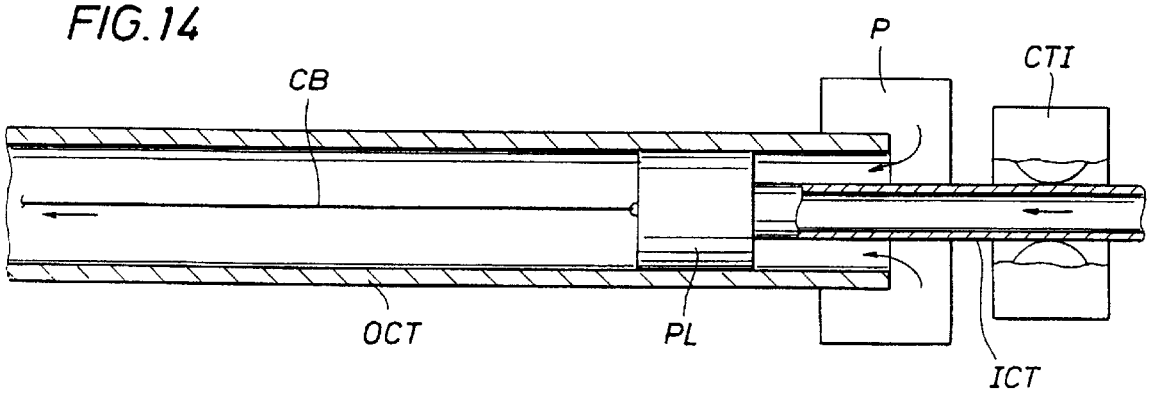
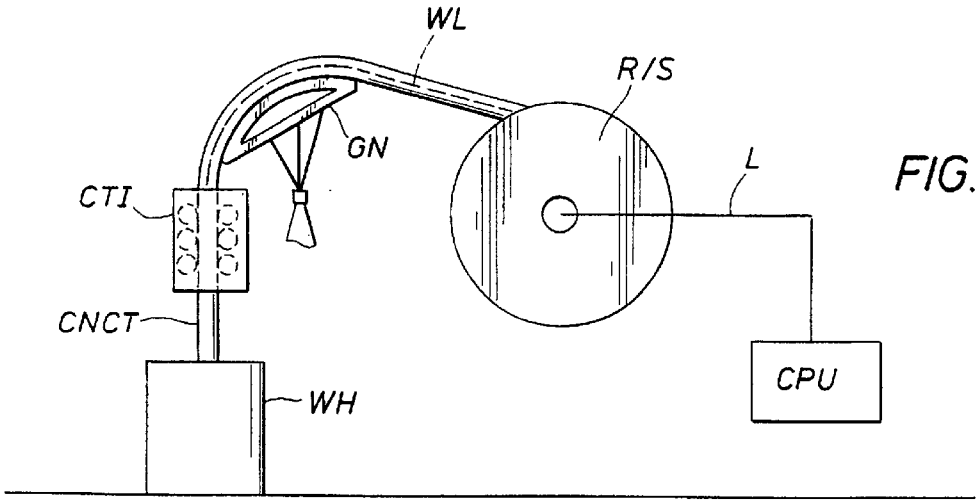
FIG. 15

METHOD AND APPARATUS USING COILED-IN-COILED TUBING

This is a Continuation-in-Part of PCT US 95/10007, filed Jul. 25, 1995, also U.S. Ser. No. 08/564,355 filed Mar. 19, 1996 now U.S. Pat. No. 5,638,904, allowed Dec. 12, 1996.

FIELD OF THE INVENTION

This invention pertains to safeguarded methods and apparatus for providing fluid communication with coiled tubing, useful in communicating fluids within wells, and particularly applicable to drill stem testing and/or operations in sour wells. The invention further pertains to multicentric coiled-in-coiled tubing, useful for safeguarded downhole or conduit operations, and its method of assembly, including preferred and alternate methods. The invention also pertains to the use of coiled-in-coiled tubing with a bottomhole assembly package for operations that may be particularly pertinent to horizontal and/or deviated wells, including operations such as treating or forming or testing or measuring and the like, and in particular, to combinations of the above operations performable in the same run.

BACKGROUND OF INVENTION

This application is related to and comprises a continuation in part of prior pending application having PCT Serial Number PCT/US95/10007. The corresponding U.S. Ser. No. is 08/564/355.

The oil and gas industry uses various methods to test the productivity of wells prior to completing and tying a well into a pipeline or battery. After drilling operations have been completed and a well has been drilled to total depth ("TD"), or prior to reaching TD in the case of multi-zoned discoveries, it is common to perform a drill stem test ("DST"). This test estimates future production of oil or gas and can justify a further expenditure of capital to complete the well.

The decision to "case" a well to a particular depth, known as a "casing point election", can result in an expenditure in excess of $300,000. Without a DST, a wellsite geologist must make a casing point election based on only core samples, cuttings, well logs, or other indicators of pay thicknesses. In many cases reservoir factors that were not knowable at the time of first penetration of the producing zone, and thus not reflected in the samples, cuttings, etc., can control the ultimate production of a well. A wellsite geologist's problem is exacerbated if the well is exploratory, or a wildcat well, without the benefit of comparative adjacent well information. Further, the geologist must make a casing point election quickly as rig time is charged by the hour.

A DST comprises, thus, a valuable and commonly used method for determining the productivity of a well so that optimal information is available to the geologist to make a casing point election. Traditionally the DST process involves flowing a well through a length of drill pipe reinserted through the static drilling fluid. The bottom of the pipe will attach to a tool or device with openings through which well fluids can enter. This perforated section is placed across an anticipated producing formation and sealed off from the rest of the wellbore with packers, frequently a pair of packers placed both above and below the formation. The packer placement or packing off technique permits an operator to test only an isolated section or cumulative sections. The testing can involve actual production into surface containers or containment of the production fluid in the closed chamber comprised by the pipe, pressure testing, physically retrieving samples of well fluids from the formation level and/or other valuable measurements.

The native pressure in producing reservoirs is controlled during drilling through the use of a carefully weighted fluid, referred to above and commonly called "drilling mud". The "mud" is continuously circulated during the drilling to remove cuttings and to control the well should a pressurized zone be encountered. The mud is usually circulated down the inside of the drill pipe and up the annulus outside of the pipe and is typically made up using water or oil based liquid. The mud density is controlled through the use of various materials for the purpose of maintaining a desired hydrostatic pressure, usually in excess of the anticipated native reservoir pressure. Polymers and such are typically added to the mud to intentionally create a "filter cake" sheath-like barrier along the wellbore surface in order to staunch loss of over-pressured drilling fluid out into the formation.

As can be easily appreciated, when an upper packer of a DST tool seals an annular area between a test string and a borehole wall, the hydrostatic pressure from the column of drilling fluid is relieved on the wellbore below the packer. The well below the packer, thus, can flow if an open fluid communication channel exists to the surface. At least the well will flow to the extent that native pressure present at the open formation of the isolated section exceeds the hydrostatic head pressure of the tested fluids in the drill pipe. Such produced fluids that flow to or toward the surface are either trapped in the pipe string or collected in a container of known dimensions and/or flared off. By calculating the volume of actual fluid produced, after considering such factors as the time of the test and the size of the choke used, a reasonable estimate of the ultimate potential production capacity of a well can be made. Upon occasion formation pores are too clogged, as by the drilling fluid filter cake, to be overcome by formation pressure and flow. It may be desired in such cases to deliver a gas or an acid to the formation to stimulate flow.

Many wells throughout the world contain hydrogen sulfide gas (H2S), also known as "sour gas". Hydrogen sulfide gas can be harmful to humans or livestock at very low concentrations in the atmosphere. In Alberta, Canada, sour wells commonly produce hydrocarbon fluids with concentrations of 2–4% H2S and often as high as 30–35% H2S. These are among the most sour wells in the world. It is also known that sour gas can cause embrittlement of steel, such as the steel used in drill pipe. This is especially true when drill pipe contains hardened steel, which is commonly used to increase the life of the drill string. Due to a tendency for drill pipe to become embrittled when exposed to H2S and the possibly disastrous effect of sour gas in the atmosphere with its potential for environmental damage or injury to people or animals, it is extremely uncommon to perform drill stem tests on sour wells. Even a pin hole leak in a drill pipe used for such purposes could have deleterious results.

Unfortunately, many highly productive wells are very sour and found in exploratory areas. In some cases, oil companies have been prepared to go to the expense of temporarily completing a sour well by renting production tubing and hanging it in a well without cementing casing in place, just to effect a production test. This method, due to the increase in rig time, can cost in excess of $200,000, which could be greater than the cost of a completion in shallow wells.

Coiled tubing is now known to be useful for a myriad of oilfield exploration, testing and/or production related operations. The use of coiled tubing began more than two decades ago. In the years that have followed coiled tubing has evolved to meet exacting standards of performance and to become a reliable component in the oil and gas service industry. Coiled tubing is typically manufactured from strips of low alloy mild steel with a precision cut, and rolled and seam welded in a range of OD (outside diameter) sizes, envisioned to run up to 6 inches. Currently, OD sizes are available up to approximately 4 inches. Improvements in manufacturing technology have resulted in increased material strength and consistent material quality. Development of a "strip bias weld" has improved the reliability of factory made joints in the coiled tubing string. Heat treatment and material changes have increased resistance of the tubing to H2S induced embrittlement and stress corrosion cracking that can incur in operations in sour environments. An increase in wall thickness and the development of higher strength alloys are also allowing the industry to increase the depth and pressure limits within which the tubing may be run. The introduction of new materials and structure, such as titanium and composite material tubing design, is also expected to further expand coiled tubing's scope of work.

Coiled tubing could be particularly valuable in sour or very sour wells due to coiled tubing's typically softer steel composition that is not so susceptible to hydrogen sulfide embrittlement. However, another factor inhibits producing sour gas or performing a DST in a sour well with coiled tubing. The repeated coiling and uncoiling of coiled tubing causes tubing walls, presently made of the steel, to plastically deform. Sooner or later the plastic deformation of the tubing wells is likely to cause a fracture. A resulting small pin hole leak or crack could produce emissions.

Oil and gas operations have known the use of concentric pipe strings. Concentric pipe strings provide two non wellbore channels for fluid communication downhole, typically with one channel, such as the inner channel, used to pump fluid (liquid or gas or multiphase fluid) downhole while a second channel, such as the annular channel formed between the concentric strings, used to return fluid to the surface. (A further annulus created between the outer string and the casing or liner or wellbore could, of course, be used for further fluid communication). Which channel is used for which function can be a matter of design choice. Both concentric pipe channels could be used to pump up or down.

Concentric tubing utilizing coiled tubing, at least in part, has been proposed for use in some recent applications. Coiled tubing enjoys certain inherent advantages over jointed pipe, such as greater speed in running in and out of a well, greater flexibility for running in "live" wells and greater safety due to requiring less personnel to be present in high risk areas and the absence of joints and their inherent risk of leaks.

Patterson in U.S. Pat. No. 4,744,420 teaches concentric tubing where the inner tubing member may be coiled tubing. It is inserted into an outer tubing member after that member has been lowered into the wellbore. In Patterson the outer tubing member does not comprise coiled tubing. As FIG. 8 of Patterson illustrates, the inner tubing is secured within the outer tubing by spaced apart spoke-like braces or centralizers which hold the tubing members generally centered and coaxial. Sudol in U.S. Pat. No. 5,033,545 and Canadian Patent No. 1325969 discloses coaxially arranged endless inner and outer tubing strings. Sudol's coaxial composite can be stored on a truckable spool and run in or pulled out of a well by a tubing injector. Sudol's disclosure does not explicitly disclose how the coaxial tubing strings are maintained coaxial, but Sudol does show an understanding of the use of centralizers. U.S. Pat. No. 5,086,8422 to Cholet discloses an external pipe column 16 which is inserted into a main pipe column comprising a vertical section and a curved section. An internal pipe column is then lowered into the inside of the external pipe column. Cholet teaches that the pipe columns may be formed to be the rigid tubes screwed together or of continuous elements unwound from the surface. Cholet does not teach a single tubing composite that itself is wound on a spool, the composite itself comprising an inner tubing length and an outer tubing length. All of Cholet's drawings teach coaxial concentricity. U.S. Pat. No. 5,411,105 to Gray teaches drilling with coiled tubing wherein an inner tubing is attached to the reel shaft and extended through the coiled tubing to the drilling tool. Gas is supplied down the inner tube to permit underbalanced drilling. Gray, like Sudol, discloses coaxial tubing. Further, Gray does not teach a size for the inner tube or whether the inner tube comprises coiled tubing. A natural assumption would be, in Gray's operation, that the inner tube could comprise a small diameter flexible tube insertable by fluid into coiled tubing while on the spool, like wireline is presently inserted into coiled tubing while on the spool. The Griffiths patent, U.S. Pat. No. 5,503,014, issued Apr. 2, 1996, filed Jul. 29, 1994, practices a version of drill stem testing using dual coaxial coil. No test tool or bottomhole assembly is taught.

The present invention solves the problem of providing a safeguarded method for communicating potentially hazardous fluids and materials through coiled tubing. This safeguarded method is particularly applicable for producing and testing fluids from wells including very sour gas wells. The safeguarded method proposes the use of coiled-in-coiled tubing, comprising an inside coiled tubing length located within an outside coiled tubing length. Potentially hazardous fluid or material is communicated through the inside tubing length. The outside tubing length provides a backup protective layer. The outside tubing defines an annular region between the lengths that can be pressurized and/or monitored for a quick indication of any leak in either of the tubing lengths. Upon detection of a leak, fluid communication can be stopped, a well could be killed or shut in, or other measures could be taken before a fluid impermissibly contaminates its surroundings.

As an additional feature, the annular region between the tubing lengths can be used for circulating fluid down and flushing up the inside tubing, for providing stimulating fluid to a formation, for providing lift fluid to the inside tubing or for providing fluid to inflate packers located on an attached downhole device, etc.

The present invention also relates to the assembly of multicentric coiled-in-coiled tubing, the proposed structure offering a configuration and a method of improved or novel design. This improved or novel design provides advantages of efficient, effective assembly, longevity of use or enhanced longevity with use, and possibly enhanced structural strength. A preferred method and alternate methods of assembly of multicentric and concentric coil-in-coil are disclosed.

It has been discovered that coiled-in-coiled tubing can offer the same benefits of flexibility and thrustability that are found in single coiled tubing when compared to jointed pipe, characteristics particularly useful for work in horizontal and/or deviated wells. However, coiled-in-coiled tubing provides the operator with two conduits as opposed to one for the communication of fluids, as from the surface to the bottomhole, or from the bottomhole to the surface, from the surface to tool combinations in a bottomhole assembly, and/or to provide an insulating chamber. These conduits are in addition, of course, to the tubing-wellbore annulus that can or could be used as a conduit.

Some operations, as discussed above and below, can benefit from the availability of a safeguarded or insulated production conduit. Some tools, as mentioned in the above discussion of Sudol and the sand vacuuming tool, prescribe two fluid conduits for their operation, and others might benefit from such.

Given the construction of prototype coiled-in-coiled tubing, it has been subsequently discovered that well operations such as treating, forming, testing and/or measuring operations and the like, and especially including combinations of the above, could be performed cost effectively on coil-in-coil. For instance, the efficiency of testing combined with well enhancing operations could be increased if performed in the same run downhole with other operations. The flexibility provided by the availability of plural conduits for pumping down, pumping up, and circulating fluids, and performing the same simultaneously or sequentially, makes possible many novel combinations of operations not before possible in a run downhole. Plural circulating conduits permit combinations of operations to be performed downhole in new, improved and novel manners. The added efficiency can justify the added cost of utilizing coil-in-coil, as well as add a safety factor.

SUMMARY OF THE INVENTION

This invention relates to the use of coiled-in-coiled tubing (several hundred feet of a smaller diameter inner coiled tube located within a larger diameter outer coiled tube) to provide a safeguarded method for fluid communication. The invention is particularly useful for well production and testing. The apparatus and method are of particular practical importance today for drill stem testing and other testing or production in potentially sour or very sour wells. The invention also relates to an improved "multicentric" coiled-in-coiled tubing design, and its method of assembly.

The use of two coiled tubing strings, one arranged inside the other, doubles the mechanical barriers to the outside environment. Fluid in the annulus between the strings can be monitored for leaks. To aid monitoring, the annular region between the coils can be filled with an inert gas, such as nitrogen, or a fluid such as water, mud or a combination thereof, and pressurized.

In one embodiment a fluid, such as water or an inert gas, can be placed in the annulus between the tubings and pressurized. This annular fluid can be pressurized to a greater pressure than either the pressure of the hazardous fluid being communicated via the innermost string or the pressure of the fluid surrounding the outer string, such as static drilling fluid. Because of this pressure differential, if a pin hole leak or a crack were to develop in either coiled tubing string the fluid in the annulus between the inner and outer string would flow outward through the hole. Instead of sour gas, for instance, potentially leaking out and contaminating the environment, the inner string fluid would be invaded by the annular fluid and continue to be contained in a closed system. An annular pressure gauge at the surface could be used to register a pressure drop in annular fluid, indicating the presence of a leak.

Communicated fluids through the inner string could be left in the closed chamber comprised of the inner string, for one embodiment, or could be separately channeled from the coiled-in-coiled tubing at the spool or working reel. Separately channeled fluids could be measured, or fed into a flare at the surface or produced into a closed container, for other embodiments.

The coiled-in-coiled tubing should be coupled or attached to a device at its distal end to control fluids flowing through the inner tube. Fluid communications through the annular channel should also be controlled. At a minimum this control might comprise simply sealing off the annular region. For drill stem testing, packers and packing off techniques could be used in a similar fashion as with standard drill stem tests. An additional benefit is provided by the invention in that a downhole packer could be inflated with fluid supplied down the coiled-in-coiled tubing.

The inner coiled tube is envisioned to vary in size between ½" (inches) and 5½" (inches) in outside diameter ("OD"). The outer coiled tube can vary between 1" and 6" in outside diameter. A preferred size is 1¼ to 1½" O.D. for the inner tube and 2" to 2⅜" O.D. for the outer tube.

It is known that steel of a hardness of less than 22 on the Rockwell C hardness scale is suitable for sour gas uses. Coiled tubing can be commonly produced with a hardness of less than 22, being without the need for the strength required for standard drill pipe. Thus, coiled tubing is particularly fit for sour gas uses, including drill stem testing, as disclosed. Other materials such as titanium, corrosion resistant alloy (CRA) or fiber and resin composite could be used for coiled tubing. Alternately, other metals or elements could be added to coiled tubing during its fabrication to increase its life and/or usefulness.

The invention further includes apparatus and method for use in downhole well operations such as treating, forming, testing or measuring and the like, and especially in combinations of the above. Treating operations refer generally to operations such as acidizing or fracturing or heating or other well stimulating activities, including injecting chemical and biological additives. Specifically, treating might refer to operations such as a polymer squeeze to close off suspected water producing zones, clay swelling control mechanisms, sand control mechanisms, filter cake removal systems, iron or sludge control and fines migration control. Treating might also refer to the addition of one or more of the following, either separately or in combination: emulsifiers, gellants, polymers, surfactants, buffers, neutralizers, corrosion control agents, inhibitors, diverting agents, breakers, cements, fluid loss control additives, detergents, cleaning agents, solvents, sequesterants, suspending agents, gels or proppants, foam or defoamers, gases, friction reducers, retarders, lost circulation material, flushes and preflushes, wax or paraffin removers, asphaltine control agents, viscosifiers, dispersants, bonding agents, cement additives and scale inhibitors. Generally, treating fluids could refer to any combination of acid and/or fracturing fluids as well as to additives thereto. Treating fluids would be mixed and applied simultaneously or sequentially according to the need of the particular formation. Treating operations could include jet cleaning and sand vacuuming operations.

Forming operations include operations such as drilling, modifying, perfing (perforating), establishing build sections and forming dog legs, as well as other activities that affect the structure and conformance of the wellbore.

Testing operations include producing operations, including both production testing and long term production. A general purpose tool might be referred to as a production/test tool.

There could be an overlap between testing tools and measuring tools. Measuring tools include the spectrum of logging tools as well as pressure measuring devices, flow meters, densitometers, locating tools, sampling tools and tools to perform chemical analyses or geological and geophysical analyses downhole.

Apparatus for use in well operations in accordance with the present invention comprises coiled-in-coiled tubing having an inner coiled tubing length contained within an outer coiled tubing length. The two tubing lengths define a first inner coil fluid conduit and a second inter-coil "annular" fluid conduit. The apparatus includes a bottomhole assembly package adapted to attach to a portion of the coiled-in-coiled tubing, typically attaching to the distal end of the coiled-in-coiled tubing, and in fluid communication with both fluid conduits defined by the coiled-in-coiled tubing.

The apparatus may include at least one packer adapted to be associated with the bottomhole assembly or the tubing. Typically the packer would be associated with the bottomhole assembly and might comprise a straddle packer. The packer optionally could be structured to permit the tubing to reciprocate or to slide while the packer packs off between a portion of the borehole wall and the tubing.

An emergency packer deflation mechanism might be included in the event of loss of communication. The mechanism could operate by pressure application to a sheer pin or a number of pins or by a variety of other methods, which would allow fluid to escape from the packers to the wellbore or to the coil tubing.

In most applications a surface control mechanism would control fluid communication within both the inner conduit and the coiled-in-coiled annular conduit. Preferably the coiled-in-coiled tubing at the surface would be connected to a spool or reel at its proximate end. The flow from both conduits could be separated with an adapting mechanism at the spool or reel to channel or control each flow separately, as desired.

A bottomhole assembly package could range from the elaborate to the simple. A drillstem test tool as disclosed in FIGS. 5 and 5A comprise one bottomhole assembly package. The tool is designed such that it could function as a production/test tool and a treatment injection tool. Valves in the tool control fluid communication between the inner and the annular conduits and the wellbore as well as between the conduits themselves. Alternately, a bottomhole assembly might comprise one or more of a production/test tool, a pump tool, a treatment injection tool, a vacuum tool, a jetting tool, a perfing tool, a drilling tool, an orienting tool, a hydraulic motor and/or an electric motor. A treatment injecting tool could inject treatment fluid. The bottomhole assembly might include a variable spacing unit. Such units could provide spacing from one to fifty meters.

Presently available tools, such as enumerated in the above list, would likely need to be adapted to work effectively with coiled-in-coiled tubing in a bottomhole assembly package. Some tools, such as a Sudol sand vacuuming tool, or a drillstem test tool as in FIG. 5, is adapted to work with coiled-in-coiled tubing. Adapting other tools to function in a bottomhole assembly package connected to coiled-in-coiled tubing may require only an appropriate sub to connect the tool fluid communication ports with the fluid communication capabilities of the coiled-in-coiled tubing, or with the tool sections above. If multiple tools are packaged in a bottomhole assembly, some provision will likely be made to port the tool's own fluid communication ports with the fluid communication ports of the above tool as well as to port fluid communication through or around the tool in order to serve tools connected below. Such engineering and design parameters can be worked out as preferred bottomhole assembly packages develop. The greater the commercial market for a particular tool package assembly, the greater the likelihood that fluid communication channels will be incorporated into the tool body self as opposed to being arranged in an ad hoc or temporary fashion.

It is envisioned that pumps associated with a bottomhole assembly may include jet pumps, chamber liftpumps, and/or electric pumps. Such pumps could function as alternate systems to recover well effluent to the surface for measurement or analysis. Electrical submersible pumps are known. A wireline will likely extend through one of the two coiled-in-coiled tubing conduits to establish electrical communication between the surface and the bottomhole assembly package. The electrical communication could serve the functions of both power and communication, as is illustrated and taught in U.S. Pat. No. 4,898,236 to Sask, entitled "Drill Stem Testing System." The important role of real time data is discussed in the Sask patent. The wireline could include a conductor within a braided line. Fibre optic wireline cables are also a possibility. If the wireline is to be included in the coiled-in-coiled annular conduit, as opposed to the inner conduit, the coiled-in-coiled tubing would likely be concentric as opposed to multicentric. Any single or multi-line conductor within a braided line or smaller coil tubing could function as a communication cable.

A variety of measuring tools may fortuitously be included in a bottomhole assembly package. Provision would be advantageously provided for multiple pressure, temperature, logging or other measurements.

The apparatus for use in well operations may omit a packer associated with the tubing and/or bottomhole assembly, as the bottomhole assembly package may include multiple tools and function that have no need for packing off. When a packer is included with the bottomhole assembly, one conduit of the coiled-in-coiled tubing could advantageously be used to hydraulically set the packer. Inflatable/deflatable strata packers may be appropriate for many operations.

The availability of the above apparatus, namely coiled-in-coiled tubing and an appropriate bottomhole assembly package, makes possible the performance of a variety of novel, efficient and cost effective downhole well operations, performable in one run. For such operations, the coiled-in-coiled tubing should be connected to the bottomhole assembly package such that both the inner and the annular fluid conduits are in fluid communication with the assembly.

The bottomhole assembly is to be located down a wellbore. Most easily the assembly is injected down the wellbore attached to the distal end of the coiled-in-coiled tubing being injected from a spool. One advantageous method of use of the above apparatus includes packing off between a portion of the wellbore and a portion of the tubing and/or assembly and pumping fluid down at least one of the two coiled-in-coiled tubing conduits for operations. Fluid, for instance, could be pumped down to set the packer. Fluid pumped down the conduit could also be advantageously used to power tools and to circulate into the wellbore. Wellbore fluid could be produced up a conduit, simultaneously or in sequence with pumping down to facilitate flushing operations.

For example, if a combination production/test and treatment injection tool, such as that of FIGS. 5 and 5A, were to comprise the bottomhole assembly, together with a packer, the methodology could include first setting the packer amid the drilling fluid in a wellbore by using water in a first conduit, preferably the annular conduit. The first conduit could then be shut off and wellbore fluid below the packer produced up the second conduit, preferably the inner conduit. The drilling fluid or mud remains in the wellbore tubing annulus above the packer. In the present example subsequent operation will not contaminate or otherwise destroy the value of this drilling fluid by circulating extraneous materials through it.

If testing of the produced fluid indicates that a well treatment might improve production, valves can be opened that permit circulation between the first conduit and the second conduit. Water in the first conduit and production fluid in the second conduit (and in the wellbore beneath the packer to a certain extent) can be circulated out and a treating fluid, such as acid, pumped down. When the fluids are suitably flushed, the second conduit can be closed and the treating fluid, such as acid, injected into the wellbore below the packer through the first conduit. The treating fluid may be followed by water. Both conduits may then be closed while the chemical acts. Production can be reestablished back up the second conduit, producing first any residual fluids in the conduit, spent acid and then formation fluid.

It can be assumed that the acid injected down the first conduit was followed by water such that when the acidizing is complete, water remains trapped in the first conduit. The formation fluid can be advantageously tested anew. If the test results on the produced formation fluid are now satisfactory, the packer can be deflated, particularly aided by using a conduit to depressurize the packer chamber, and the process repeated at another location. If the test results are unsatisfactory, the flush and treatment cycle can be repeated, using the same or different treatment fluids. Straddle packers can be used in lieu of a single packer to suitably isolate a production zone.

If testing indicates that a zone produces water, a polymer squeeze chemical could be applied through one conduit, such as the first conduit, to wall off the zone from production. The success or effectiveness of the polymer squeeze could be immediately subsequently tested by production with the tool. In the above sequence of operations, the drilling fluid in the well above the packer has not been contaminated by the necessity to flush any fluids through the wellbore-tubing annulus above the packer.

A packer might be set downhole such that it permits coiled-in-coiled tubing to slidingly reciprocate while the packer packs off between the wellbore and the tubing wall. Some treating operations such as sand vacuuming and/or jet cleaning require the movement of a tool during operation. Drilling also depends upon movement of the coiled tubing within the wellbore. A packer permitting the tubing to reciprocate through it, set at a build section, might permit, for instance, a horizontal well to be overbalanced in its vertical section, having drilling fluid above the packer, and underbalanced in its horizontal section below the packer. Gas could be pumped down one of the two conduits with liquid down the other, both to the bit, to drill under variably balanced conditions while providing adequate cooling and lifting power to the bit and at the same time a conduit carrying only liquid for acoustic communication and hydraulic fluid.

In one methodology, with or without a packer, fluid could be pumped down both conduits to a bottomhole assembly where each fluid comprises either a hydraulic operating fluid or a well treatment fluid. This methodology would permit the mixing of chemicals downhole. For instance, a first and second chemical might pump more favorably unmixed, such as fracturing fluid and gel setting chemicals and/or gel breaking chemicals, or such as two different acids. It is sometimes advantageous to have two different treatment fluids that are not mixed until ready for use. Heat could be generated downhole more safely by the mixture there of two chemicals.

Combustion downhole might be controlled by a controlled supply of oxygen. Two different tools could be hydraulically operated, each having their own independent hydraulic pressure and flow rate controlled at surface, as a hydraulically operated bit and a hydraulically operated orienting tool, or a hydraulically operated bit and a hydraulic jetting tool. One conduit could contain hydraulic fluid for operating a rotary cleaning jet while the other conduit contained a fluid, such as an acid fluid, for selectively dispensing out the rotating jets. Hydraulic fluid down one conduit could operate a pump while a treating or jetting fluid could be administered through the other conduit. In one embodiment a rotating jet cleaning tool could be operated together with a sand vacuuming tool. Many such tools could be computer controlled through real time feed back data.

In another methodology the outer conduit could be used to provide thermal insulation for fluid in the inner conduit. For example, viscous oil could be produced through the inner conduit while thermal insulation could be provided by a fluid, such as a gas, air, a gel or other insulation material in the outer conduit. For the purposes of the present disclosure a vacuum should be considered as a "gas" fluid, as it represents a limiting condition for the presence of a gas. Such insulating fluid could keep the oil temperature up and thus the oil viscosity down so that the oil could be more readily brought to surface.

One utilization of the present invention includes a methodology in which the bottomhole assembly comprises at least a pair of valved producing/treating tools separated by a bottomhole assembly spacer. Wellbore fluid could be produced from two different locations, each up a different conduit. The embodiment could be operated with or without packers. Advantageously the two producing tools could be separated by a packer in order to test alternative producing zones.

A surface computer system could be advantageously employed to recover and analyze data in real-time in order to calculate reservoir parameters. The same surface computer system could be used to control all downhole tool valves for the movement of all fluids and gases. The apparatus and method advantageously includes capability for remote data transmission from the well site to another location.

The present invention also includes optimal methods for assembling coiled-in-coiled tubing. These methodologies include extending a first length of coiled tubing essentially horizontally. A second inner coiled tubing length could then be pumped through the first coiled tubing length and/or pulled through the first coiled tubing length, by means of a cable, and/or injected through the first coiled tubing length by means of a coiled tubing injector. Any combination of pumping, pulling and injecting, together with lubricating between the coils, could be used simultaneously or sequentially to accomplish the assembling of coiled-in-coiled tubing.

BRIEF DESCRIPTION OF THE DRAWINGS

A better understanding of the present invention can be obtained when the following detailed description of the preferred embodiment is considered in conjunction with the following drawings, in which:

FIGS. 2A, 2B and 2C illustrate a working reel for coiled tubing with plumbing and fittings capable of supporting an inner coil with an outer coil.

FIG. 7 illustrates an injection technique for injecting an inner coil within an outer coil to produce "multicentric" coiled-in-coiled tubing.

FIG. 13 illustrates coiled-in-coiled tubing attached to a bottomhole assembly located downhole in a wellbore having a packer sealing a wellbore annulus at the build section and providing for reciprocation of the tubing within the packer.

FIG. 14 illustrates a horizontal method of assembly for coiled-in-coiled tubing.

FIG. 15 illustrates the use of computer control with coiled-in-coiled tubing and a bottomhole assembly.

DETAILED DESCRIPTION OF THE PREFERRED EMBODIMENTS

Figure 1:
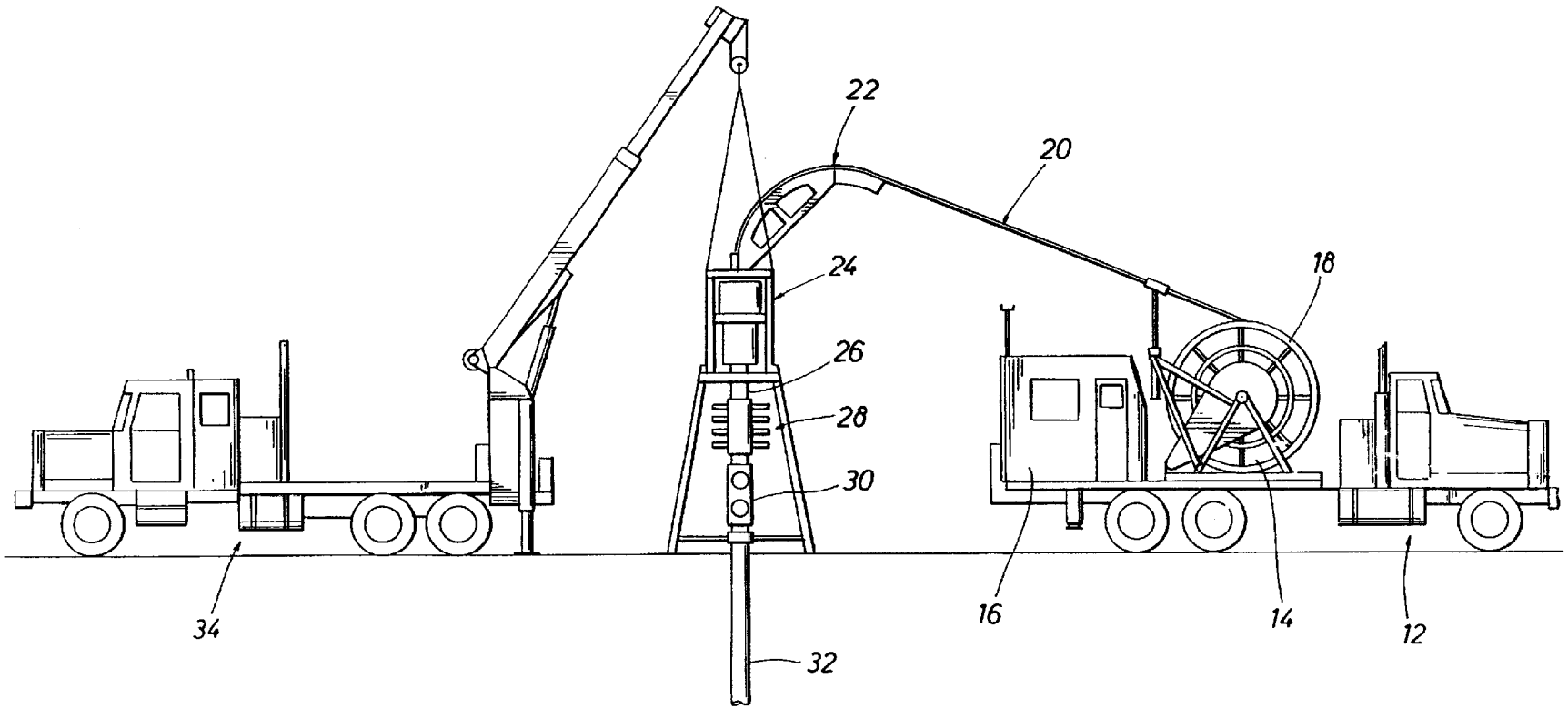
FIG. 1 (PRIOR ART)
FIG. 1 illustrates typical equipment used to inject coiled tubing into a well.

FIG. 1 illustrates a typical rigup for running coiled tubing. This rigup is known generally in the art. In this rigup truck 12 carries behind its cab a power pack including a hook-up to the truck motor or power take off, a hydraulic pump and an air compressor. The coiled tubing injecting operation can be run from control cab 16 located at the rear of truck 12. Control cab 16 comprises the operational center. Work reel 14 comprises the spool that carries the coiled tubing at the job site. Spool or reel 14 must be limited in its outside or drum or spool diameter so that, with a full load of coiled tubing wound thereon, the spool can be trucked over the highways and to a job site. A typical reel might offer a drum diameter of ten feet. Reel 14, as more fully explained in FIGS. 2 and 3, contains fixtures and plumbing and conduits to permit and/or control communication between the inside of the coiled tubing string and other instruments or tools or containers located on the surface.

FIG. 1 illustrates coiled tubing 20 injected over gooseneck guide 22 by means of injector 24 into surface casing 32. Injector 24 typically involves two hydraulic motors and two counter-rotating chains by means of which the injector grips the tubing and reels or unreels the tubing to and from the spool. Stripper 26 packs off between coiled tubing 20 and the wellbore. The well is illustrated as having a typical well Christmas tree 30 and blowout preventor 28. Crain truck 34 provides lifting means for working at the well site.

Figure 2A:
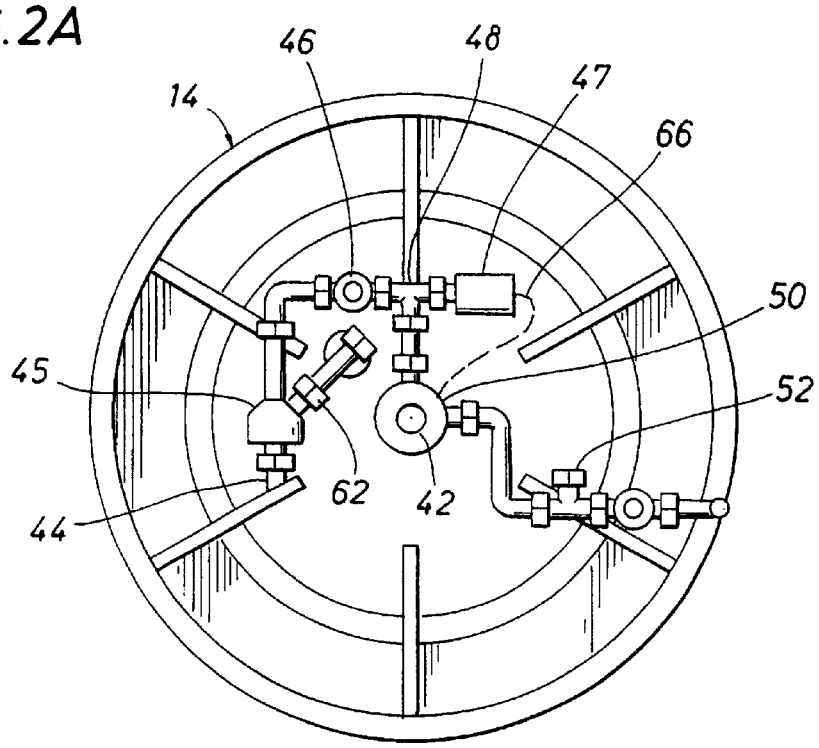
Figure 2C:
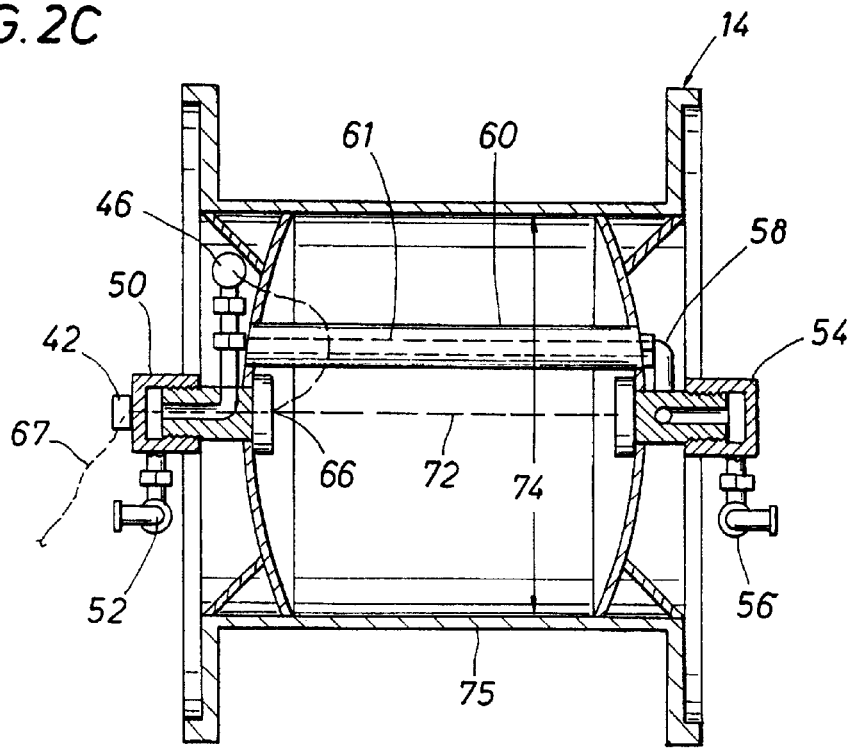

FIGS. 2A, 2B and 2C illustrate side views and a top cutaway view, respectively, of a working reel 14 fitted out for operating with coiled-in-coiled tubing.

FIG. 2A offers a first side view of working reel 14. This side view illustrates in particular the plumbing provided for the reel to manage fluid communication, as well as electrical communication, through the inner coiled tubing. The inner tubing is the tubing designated for carrying the fluid whose communication should be safeguarded, fluid that might be hazardous. The coiled-in-coiled tubing connects with working reel 14 through rotating connector 44 and fitting 45. Aspects of connector 44 and fitting 45 are more particularly illustrated in FIG. 3. This plumbing connection provides a lateral conduit 62 to channel fluid from the annular region between the two tubing lengths. Fluid communication through lateral conduit 62 proceeds through a central portion of reel 14 and a swivel joint on the far side of working reel 14. These connections are more particularly illustrated in FIGS. 2B and 2C, discussed below. Fluid from inside the inner coiled tubing, as well as wireline 66, communicate through high pressure split channel valve fixture 45 and into high pressure piping 46. High pressure channel splitter 45 as well as high pressure piping 46 are suitable for H2S service and rotate with reel 14. Lateral conduit 62 also rotates with reel 14. Wireline telemetry cable 66, which connects to service downhole tools and provide real time monitoring, controlling and data collecting, passes out of high pressure piping 46 at connector 47. Telemetry line 66, which may be a multiple line, connects with a swivel joint wireline connector 42 in a manner known in the industry.

Swivel pipe joint 50 provides a fluid connection between the high pressure non-rotating plumbing and fittings connected to the axis of working reel 14 and the rotating high pressure plumbing attached to the rotating portions of the drum, which are attached in turn to the coiled tubing on the reel. High pressure conduit 52 connects to swivel joint 50 and comprises a non-rotating plumbing connection for fluid communication with the inner coiled tubing. Valving can be provided in the rotating and/or non-rotating conduits as desired or appropriate. Conduit 52 can lead to testing and collecting equipment upon the surface related to fluid transmitted through the inner coiled tubing.

FIG. 2B offers a side view of the other side of working reel 14 from that shown in FIG. 2A. FIG. 2B illustrates plumbing applicable to the annular region between the two coils of the coiled-in-coiled tubing. Conduit 58 comprises a rotating pipe connecting with the other side of reel 14 and conduit 61 providing fluid communication through a central section 60 of the reel. Conduit or piping 58 rotates with the reel. Swivel joint 54 connects non-rotating pipe section 56 with rotating pipe 58 and provides for fluid communication with the annular region for fixed piping or conduit 56 at the surface. Piping 56 may be provided with suitable valving for controlling communication from the annular region between the two coiled tubing strings with appropriate surface equipment. Such surface equipment could comprise a source of fluid or pressurized fluid 76, indicated schematically. Such fluid could comprise gas, such as nitrogen, or water or drilling mud or some combination thereof. Monitoring means 78, also illustrated schematically, may be provided to monitor fluid within the annular region between the inner and outer coiled tubing. Monitoring equipment 78 might monitor the composition and/or the pressure of such fluid in the annular region, for example.

FIG. 2C illustrates a top cutaway view of working reel 14. FIG. 2C illustrates spool diameter 74 of working reel 14. Spool surface 75 comprises the surface upon which the coiled-in-coiled tubing is wound. Surface 75 is the surface from which the tubing is reeled and to which it is respooled. FIG. 2C illustrates wireline connector 42 connecting to wireline 66 and from which electrical line 67 is illustrated as emerging. Wireline 66 and electrical line 67 can be complex multi-stranded lines. Dashed line 72 illustrates the axial center of working reel 14, the axis around which working reel 14 rotates. The right side of FIG. 2C illustrates rotating plumbing or conduit 58 and non-rotating plumbing or conduit 56, both illustrated in FIG. 2B. They provide for fluid communication at the surface with the annular region between the coiled tubing strings. Conduit 61 communicates through channel 60 in working reel 14 to connect conduit 58 with lateral 62 on the far side of working reel 14. Conduit 61 and channel 60 rotate with the rotation of the drum of working reel 14. The left side of FIG. 2C illustrates rotating pipe 46 and non-rotating pipe or conduit 52. As discussed in connection with FIG. 2A, these sections of pipe or conduit provide for fluid communication between the inner coiled tubing string and surface equipment, if desired.

Figure 3:
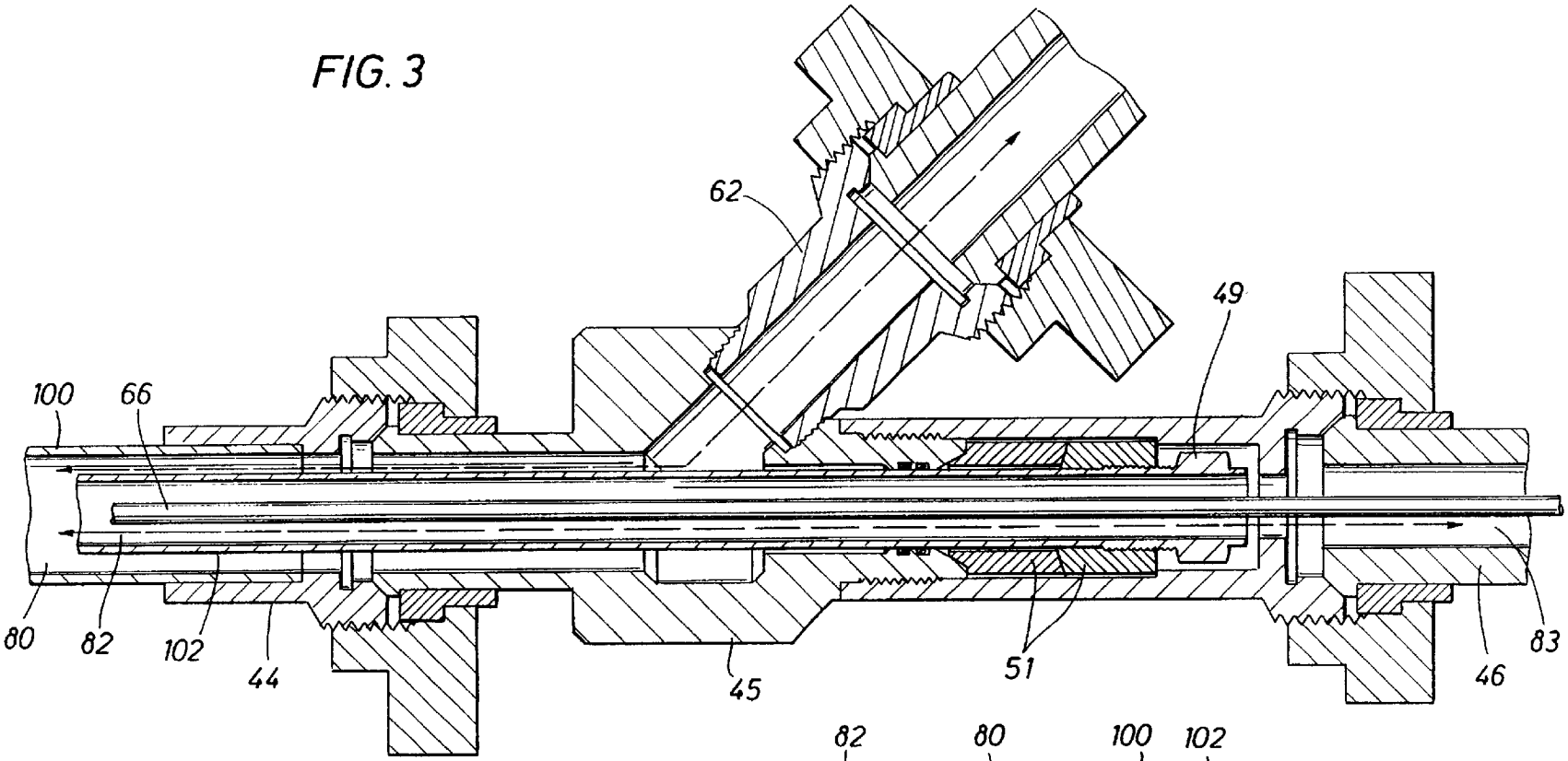
FIG. 3 illustrates in cross-section an embodiment for separating or splitting inner and outer fluid communication channels into side-by-side fluid communication channels.

Split channel plumbing 45 providing lateral 62 is illustrated in cross-section more particularly in FIG. 3. Wireline 66 is shown entering plumbing fixture 45 from the left side and emerging on the right side in fluid communication channel 83. Channel 83 is in communication with the inside of the inner tubing string. Bushing 49 anchors inner tubing 102 within plumbing fixture 45. Packing and sealing means 51 prevents communication between the annular area 80, defined between outer tubing 100 and inner tubing 102, and fluid communication channel 83. Fitting 44 anchors outer coiled tubing 100 to fixture 45.

Figure 4:
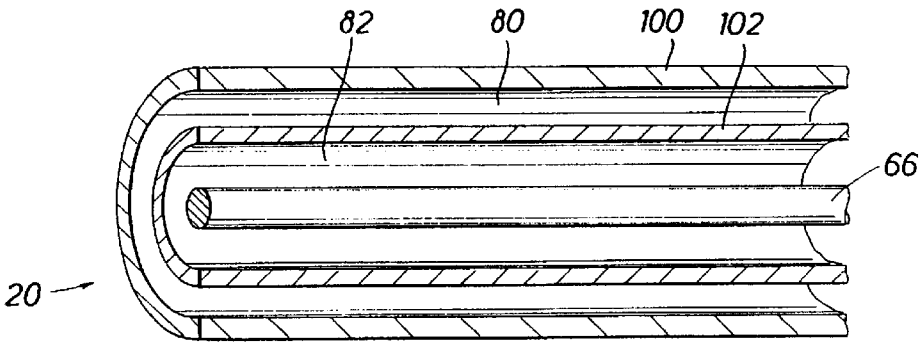
FIG. 4 illustrates in cross-section an inner and an outer coiled tubing section having a wireline within.

FIG. 4 illustrates in cutaway section components of coiled-in-coiled tubing. FIG. 4 illustrates cable or wireline 66 contained within inner tubing 102 contained in turn within outer tubing 100. Cable 66 could comprise fiber optic cable for some applications. Channel 82 identifies the channel of fluid communication within inner tubing 102. Annular area 80 identifies an annular region between tubings, providing for fluid communication between inner tubing 102 and outer tubing 100 if desired. A typical width for inner tubing 102 is 0.095 inches. A typical width for outer tubing 100 is 0.125 inches.

Figure 5:
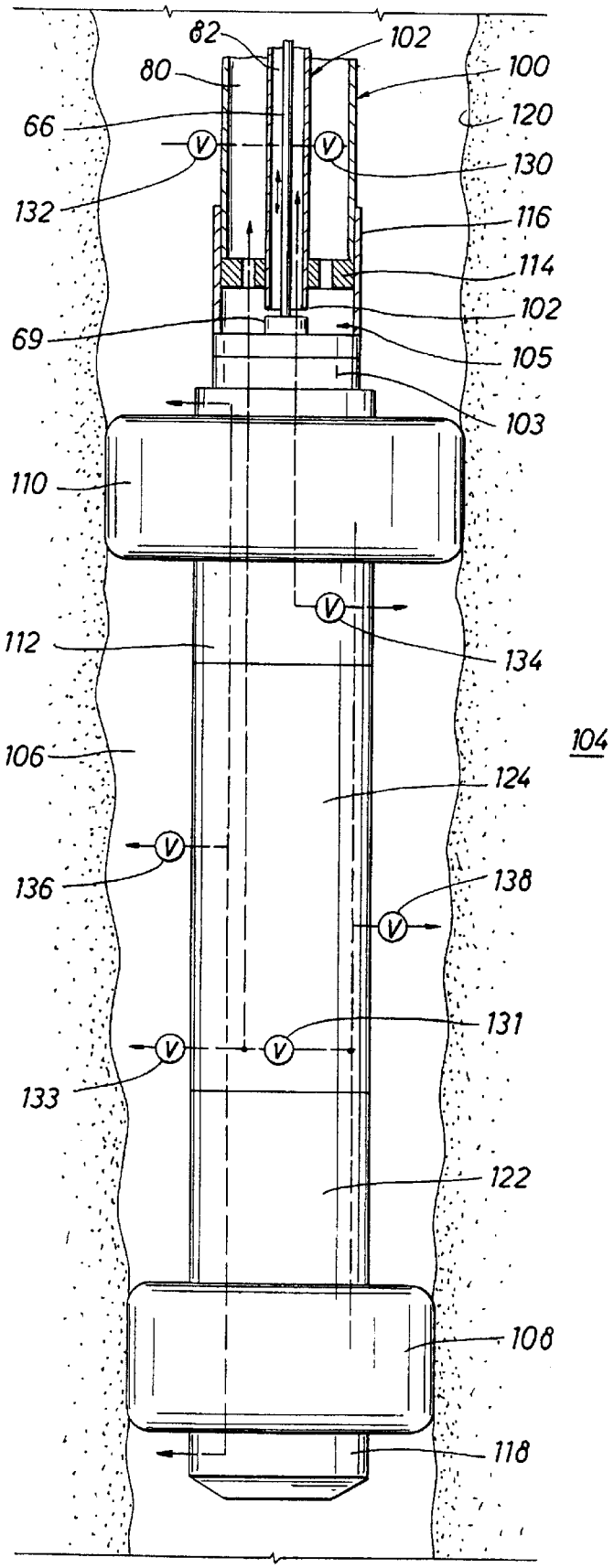
FIGS. 5 and 5A illustrate an embodiment of a downhole device or tool, adapted for attachment to coiled-in-coiled tubing, and useful for controlling fluid flow between a wellbore and an inner coiled tubing string as well as between the wellbore and an annular region between inner and outer coiled tubing strings, and also useful for controlling fluid flow between the inner coiled tubing string and the annular region.

FIG. 5 illustrates an embodiment, schematically, of a downhole tool usable with coiled-in-coiled tubing, and in particular useful for drill stem testing. Tool or device 112 is attached by means of slip connector 116 to the outside of outer tubing 100. Tool 112 is shown situated in region 106 defined by borehole 120 in formation 104. Packers 108 and 110 are shown packing off between tool 112 and borehole 120 in formation 104. If formation 104 is capable of producing fluids, they will be produced through wellbore 120 in the zone defined between upper packer 110 and lower packer 108. Tool bull nose 118 lies below lower packer 108.

Indicated region 122 in tool 112 refers to a general packer and tool spacer area typically incorporated within a device 112. Spacers are added to adjust the length of the tool. Provision may be made in this space, as is known in the art, to collect downhole samples for retrieval to the surface. Indicated region 124 in tool 112 refers to a general electronic section typically incorporated within a device 112. Anchor 114 anchors inner coiled tubing 102 within outer coiled tubing 100 at device 112 while continuing to provide means for fluid communication between annular region 80 between the two tubing lengths and portions of tool 112.

Valving provided by the tool is indicated stylistically in FIG. 5. Valve 130 performs the function of a circulation valve, permitting circulation between annular region 80 between the coils and fluid communication channel 82 within inner coiled tubing 102. Valve 130 could be used to circulate fluid down annular region 80 and up inner tubing channel 82, or vice versa. Wireline 66 would commonly terminate at a wireline termination fitting, illustrated as fitting 69 in tool 112. Valve 132 indicates valving to permit fluid communication between inner channel 82 and the borehole above upper packer 110. Valve 134 permits well fluids from formation 104 within borehole annular region 106 to enter into downhole tool 112 between upper packer 110 and lower packer 108 and from thence into inner tubing conduit 82. Valve 136 indicates an equalizing valve typically provided with a tool 112. Valve 131 provides for the inflation of packers 110 and 108 by fluid from annular regions 80. Valve 133 is available for injecting fluids from annular region 80 into the formation, for purposes such as to stimulate formation 104. Connector 105 between the tubing and downhole tool could contain an emergency release mechanism 103 associated therewith, as is known in the art. Valve 138 provides for deflating packers 108 and 110.

Figure 6:
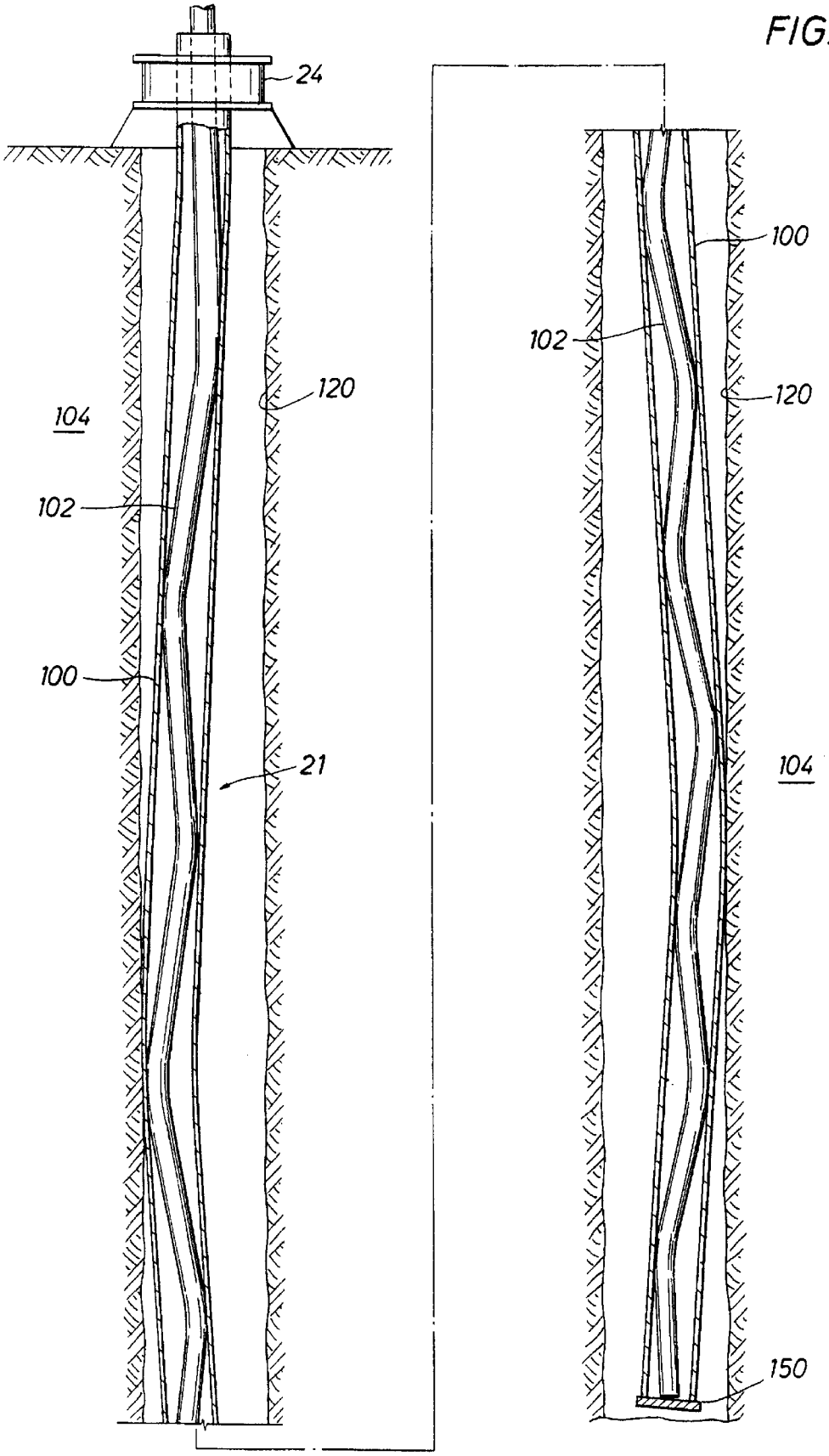
FIG. 6 illustrates helixing of an inner coil within an outer coil in "multicentric" coiled-in-coiled tubing.

FIG. 6 illustrates a helixed inner coil 102 within an outer coil 100 forming "multicentric" coiled-in-coiled tubing 21, shown strung in well 120 through formation 104. It is believed that when hung in a vertical well a coiled tubing, such as outer coil 100, would not hang completely straight. However, the weight of the coil would insure that outer coil 100 hung almost straight. Cap 150 is shown attached to the distal end of outer coil 100, downhole in well 120. Inner coil 102 is illustrated as helixed within outer coil 100. This helixing provides a lack of concentricity, or coaxiality, and is intentional. The intentional helixing provides a multicentricity for the tubes, as opposed to concentricity or coaxiality. The helixing can be affected between an inner coil 102 and an outer coil 100 and is believed will not always take the same direction. That is, the helixing might alternate between clockwise and counterclockwise directions. Inner coil 102 is illustrated in FIG. 6 as having its weight landed upon bottom cap 150 attached to outer coil 100. In this fashion, the weight of inner coil 102 is being borne by outer coil 100, illustrated as hung by a coiled tubing injector mechanism 24. Alternately, the weight of inner coil 102 could be landed on the bottom of well 120, or cap 150 could sit on the bottom of well 120, thereby relieving outer coil 100 of bearing the weight of inner coil 102.

FIG. 7 illustrates inner coiled tubing 102 spooled from spool 152 over gooseneck 154 and through inner coiled tubing injector 156 into outer coiled tubing 100. Outer coiled tubing 100 is illustrated as hung by coiled tubing injector 24 into well 120 in formation 104.

Figure 8A:
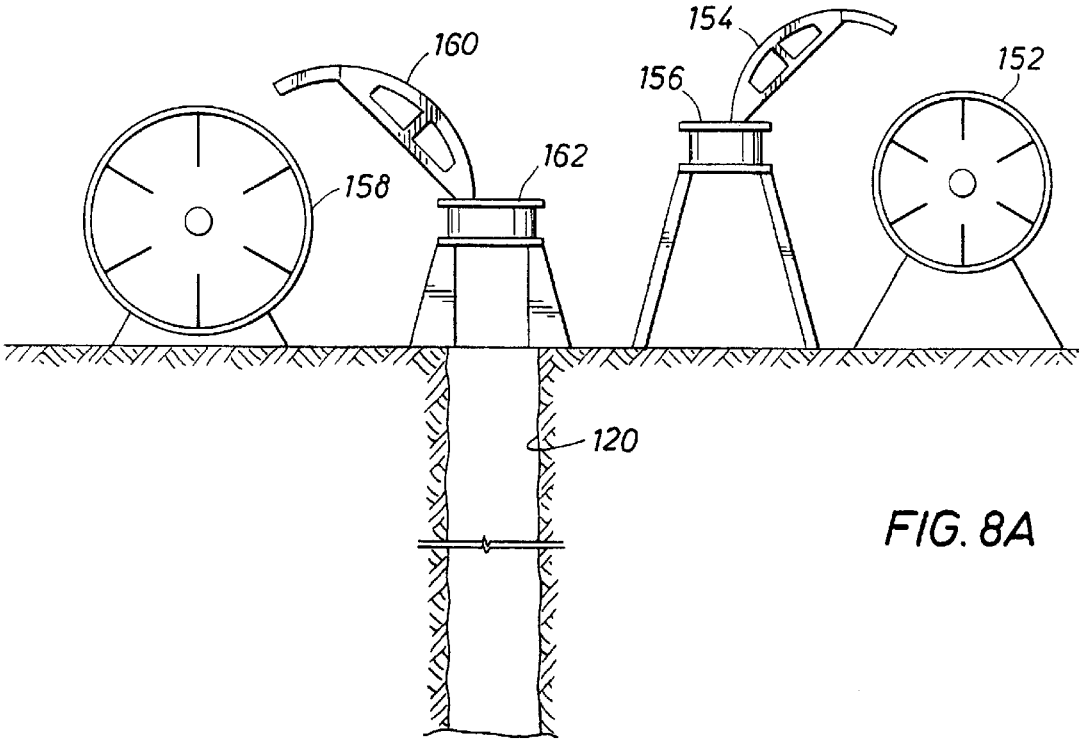
FIG. 8 illustrates a method of assembling "multicentric" coiled-in-coiled tubing.
Figure 8B:
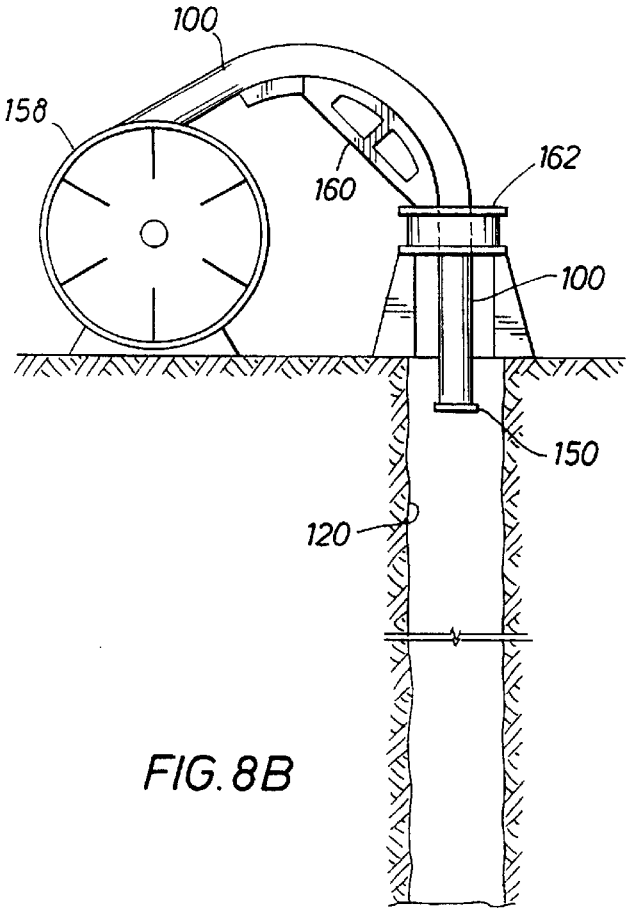
Figure 8C:
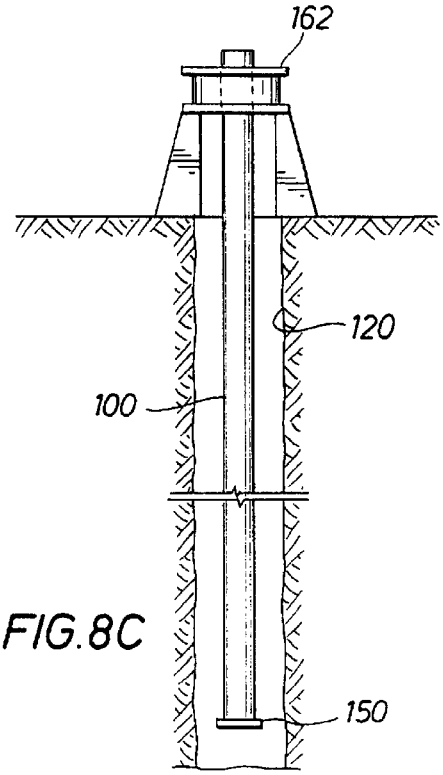

FIGS. 8A through 8F illustrate a method for assembling multicentric coiled-in-coiled tubing 21 on reel 14, as illustrated in FIG. 8G. FIG. 8A illustrates spool 152 holding inner coiled tubing 102 sitting beside well 120. With spool 152 is inner coiled tubing injector 156 and inner coiled tubing gooseneck support 154. Also at well site 120 is outer coiled tubing spool 158, outer coiled tubing injector 162 and outer coiled tubing gooseneck 160. FIG. 8B illustrates outer coil 100 being injected by coiled tubing injector 162 into well 120 from spool 158 and passing of a gooseneck 160. FIG. 8C illustrates outer coiled tubing 100 hung by outer coiled tubing injector 162 over well 120. Gooseneck 160 and spool 158 have been removed. Outer coiled tubing 100 is shown having cap 150 affixed to its distal or downhole end. FIG. 8D illustrates inner coiled tubing 102, injected and helixed into outer coil 100 hung in well 120. Inner coil 102 is injected from spool 152 over gooseneck 154 and by injector 156. The bottom of inner coil 102 is shown resting upon cap 150 at the downhole end of outer coil 100, hung in well 120 by outer coil injector 162. FIG. 8E illustrates inner coil 102 being allowed to relax and to sink, to helix and to spiral further, inside outer coiled tubing 100 hung by injector 162 in well 120. FIG. 8F illustrates respooling coiled-in-coiled tubing 21 onto working reel 14 using outer coiled tubing injector 162 and outer coiled tubing gooseneck 160. Outer tubing 100 has been connected to reel 14. If separate means for hanging outer tubing 100 are provided, the operation can be carried out with one coiled tubing injector and one gooseneck.

In operation, the safeguarded method of the present invention for the communication of fluid from within a well is practiced with coiled tubing carried on a spool. The method is practiced by attaching a distal end of coiled-in-coiled tubing from a spool to a device for controlling fluid communication. The device, a specialized tool for the purpose, will be inserted into a well. (The safeguarded method for fluid communication would also, of course, be effective on the surface. Safeguarded communication from within a well offers the difficult problem to solve.)

Coiled-in-coiled tubing comprises a first coiled tubing length situated within a second coiled tubing length. A first channel for fluid communication is defined by the inside tubing length. The device or tool attached at the distal end of the coiled-in-coiled tubing controls fluid communication through this first inner communication channel. The device may also control some fluid communication possibilities through an annular region as well. An annular region is defined between the first inner coiled tubing length and the second outer coiled tubing length. Fluid communication is also to be controlled, at least to a limited extent, within this annular region. At the least, such control should extend to sealing off the annular region to provide the margin of safety in the case of leaks in the inner tubing. Preferably, such control would include a capacity to monitor the fluid status, such as fluid composition and/or fluid pressure, within such region, for leaks. Preferably such control would include a capacity to pressurize a selected fluid within the annular region, to more speedily detect leaks. In preferred embodiments, the annular region may also function as a second fluid communication channel.

The coiled-in-coiled tubing is injected from a spool into the well. Primary fluid is communicated through the inside tubing length from the well to the spool. Of course, fluid could also be communicated in a safeguarded manner from the spool to the well, if such need arose.

The primary fluid may remain contained within the inside tubing length, as in a closed chamber, to minimize risk. Alternately the fluid may be communicated from the inside tubing length through a swivel joint located upon the spool to other equipment and/or surface containers. The coiled-in-coiled tubing is eventually respooled.

The device for controlling fluid communication through the inside tubing length usually comprises a specialized tool developed for multiple purposes, fitted to operate in conjunction with coiled-in-coiled tubing. The tool may communicate electronically through a wireline, probably multistrand, run through the inside tubing. The tool may also collect one or more samples of fluid and physically carry the samples upon respooling, to the surface. The tool may further contain means for measuring pressure.

The annular region between the inside and the outside coiled tubing provides the safeguard, the secondary protective barrier in case of leaks in the inside tubing, for the present method for fluid communication. For that reason, as mentioned above, fluid in the annular region should at least be controlled in the sense that control comprises sealing off the annular region. As discussed above, preferably, the control includes monitoring fluid status within the annular region, such as fluid composition and/or fluid pressure, and may include supplying pressurized fluid to the annular region, such as pressurized water, inert gas or nitrogen, drilling mud, or any combination thereof. The pressure of such monitoring fluid can be monitored to indicate leaks in either of the coiled tubing walls. Overpressuring the annular region would ensure that a leak in either the inner tubing wall or the outer tubing wall would result in annular fluid evacuating the annular region and invading the inner tubing string or the outside of the coiled-in-coiled tubing. Such overpressurization in particular guards against potentially hazardous fluid from inside the inner tubing ever entering the annular region.

Upon the indication of a leak in either coiled tubing wall, the primary fluid communication in the inner tubing could be terminated. The well may also be shut in by closing the valve and/or the well may be killed by deflating the packers. A blowout preventor (BOP) could be activated, if necessary.

The present safeguarded method for fluid communication is applicable to work within a wellbore as well as in a cased well or well tubing. Such wellbore, cased well or well tubing may itself be filled with fluid, such as static drilling fluid.

The device or tool for controlling fluid communication from the well frequently includes a packer or packers for isolating a zone of interest. The annular region between the tubing walls can be used as a fluid communication channel for supplying fluid to inflate the packers. The annular region could also be used as a fluid communication channel for supplying a stimulating fluid, such as acid, or a lifting fluid such as nitrogen, downhole to the well.

The coiled-in-coiled tubing is attached at the surface to a working reel or spool. The spool for coiled-in-coiled tubing will contain means for splitting the fluid communication channel originally from within the inner coiled tubing from the potential communication channel defined by the annular region between the coiled tubing lengths. Generally speaking, the inside length also should be no longer than 1% of the outside length.

One aspect of the present invention provides improved apparatus for practicing above the method, the improved apparatus comprising "multicentric" coiled-in-coiled tubing. Such multicentric coiled-in-coiled tubing includes several hundred feet of continuous thrustable tubing, coiled on a truckable spool. The tubing includes a first length of coiled tubing of at least ½ inch outside diameter helixed within a second length of coiled tubing. Generally speaking, taking into account the variations possible between OD's of inside and outside tubing and wall thickness, when measured coextensively the first inside length would be at least 0.01% longer than the second outside length. Generally speaking, the inside length also should be no longer than 1% of the outside length. (It is of course clear, that either the inside length or the outside length could be extended beyond the other at either the spool end or at the downhole end. "Measuring coextensively" is used to indicate that such extension of one length beyond the other at either end is not intended to be taken into account when comparing lengths.)

When coiled-in-coiled tubing is spooled, it is believed that the inner length, to the extent it overcomes friction, would tend to spool at the maximum possible spool diameter. That is, the inner length would tend to spool against the outer inside surface of the outer length. Such tendency, if achieved, would result in a significantly longer length for the inside tubing versus the outside tubing. The difference in length is significant because the present inventors anticipate that if the coiled-in-coiled tubing were allowed to assume this maximum spool diameter position on the spool and the ends were fixed to each other, then when straightened, the inner tubing would tend to fail or buckle within the outer tubing.

"Concentric" or "coaxial" tubing comprises, of course, strands of the same length. Centralizers could be used to maintain an inner tubing concentric or coaxial within an outer tubing on a spool. Alternately, an inner tubing could be inserted coaxially in a straightened position within an outer tubing, and the two ends of the two tubings could then be affixed together to prevent retreat of the inner tubing within the outer tubing upon spooling. For instance, an inner coiled tube could be injected within an outer coiled tube hung in a vertical well, possibly using means to minimize friction there between, such that, measured coextensively, the lengths of both coils would tend to hang straight and be very close to the same length. The inner coil would not be helixed within the outer coil. To help straighten out any undesired helixing, the inner coil could latch on to a cap attached to the bottom of the hung outer coil. The weight of the outer coil could then be picked up and carried by the inner coil if the inner coil were lifted subsequent to latching onto the end cap. So lifting the inner coil, bearing not only its own weight but part or all of the weight of the outer coil would help straighten the inner coil out within the outer coil and align the two coils. This solution, "coaxial" or "concentric" coils is believed not to be optimal. Coaxiality might result in an unacceptable level of compression and/or tension being placed upon on portions of one and/or the other length while resting on the spool.

It is proposed by the present inventors that the "multi-centric" coiled-in-coiled tubing disclosed herein best solves the above problems without involving the complexity of centralizers. Helixing the inner coil within the outer coil provides an advantageous amount of frictional contact between the two coils, frictional contact that is dispersed relatively uniformly. Furthermore, the inner coil has a certain amount of flexibility in which to adjust its configuration longitudinally upon spooling in and out. The helixed inner coil should not buckle or fail upon respooling and spooling. The frictional contact is sufficient between the helixed inner coil and outer coil that unacceptably high areas of compression or tension between the two coils are not created while on the spool. The helixed inner coil, under certain circumstances, may even enhance the structural strength of the coiled-in-coiled tubing as a whole.

Figure 9:
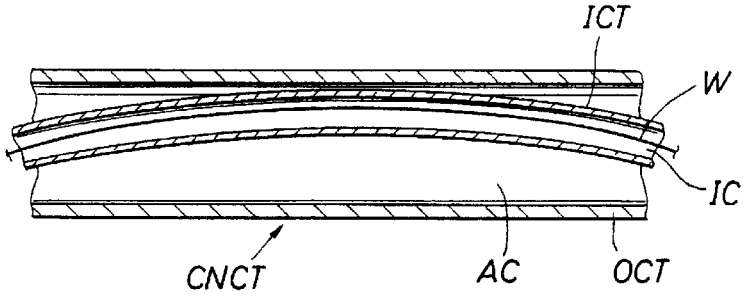
FIG. 9 illustrates coiled-in-coiled tubing having wireline within the inner tubing and the inner tubing helixed within the outer tubing.
Figure 10:
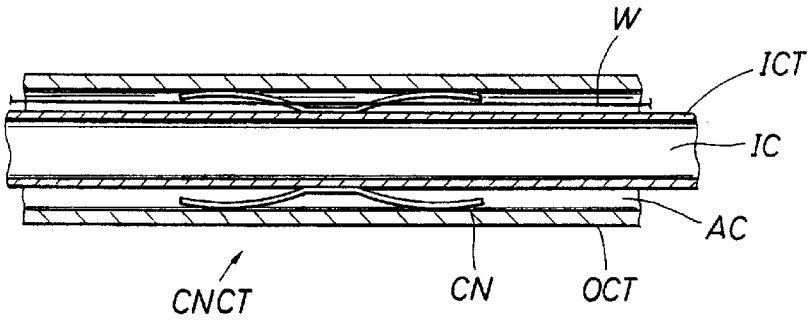
FIG. 10 illustrates coiled-in-coiled tubing having an inner tubing centralized within an outer tubing and having a wireline extending in the annulus between the inner and outer tubing.

FIG. 9 illustrates an embodiment for coiled-in-coiled tubing wherein an inner coil is helixed within an outer coil and a wireline cable or fibre optic cable or braided cable, or the like, is included within the conduit provided by the inner coil. FIG. 10, in contrast, illustrates a concentric coil-in-coil arrangement. In FIG. 10, centralizer CN maintains inner coil tubing ICT, defining a first conduit IC, centralized within outer coiled tubing OCT. A second annular fluid conduit AC is defined in the annulus between inner coil ICT and outer coil OCT. FIG. 10 illustrates wireline W located in the annular conduit AC.

Figure 11:
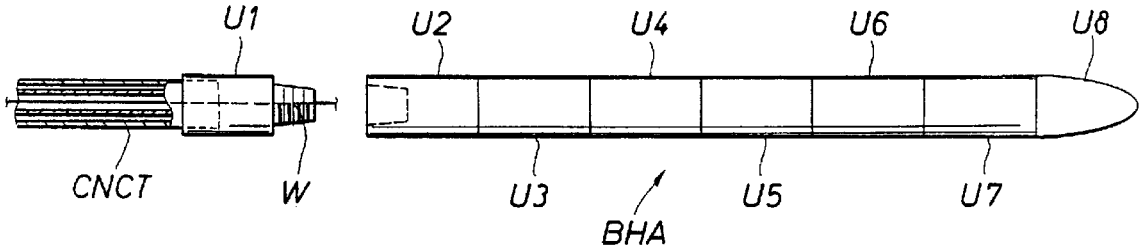
FIG. 11 illustrates schematically a bottomhole assembly package.

FIG. 11 illustrates schematically a bottomhole assembly package BHA comprised of multiple units. Coiled-in-coiled tubing CNCT having wireline W located inside the inner coil is shown affixed to unit U1. Unit U1 may be a sub, preferably a multi-purpose coiled-in-coiled tubing head for connecting to a bottomhole assembly package such that both conduits IC and AC are in fluid communication with package BHA.

In bottomhole assembly BHA, each unit, U2–U8, could indicate a different tool or measuring instrument or packer or spacer. Bottomhole assembly BHA is shown with the tools and/or instruments mated together and in preparation for mating its upper end with the coiled-in-coiled tubing head. Units U1 through U8 would be provided for mating such that fluid communication is continued through most, if not all, units with both the first conduit IC and the second conduit AC, as well as with wire line W.

Figure 12:
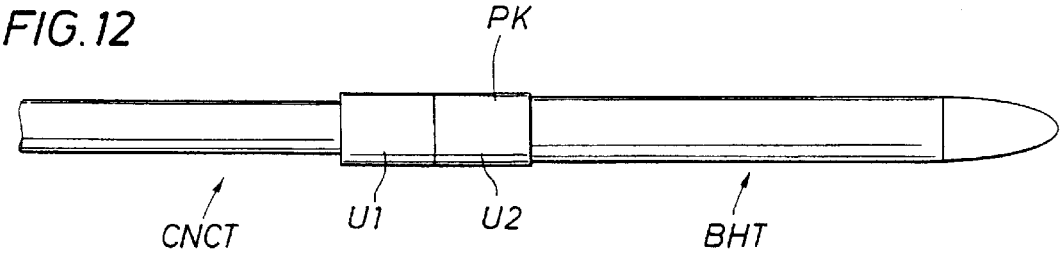
FIG. 12 illustrates a bottomhole assembly including an assembly unit where a packer might be carried.

FIG. 12 illustrates that a packer might well be carried in an early unit, such as Unit U2. FIG. 13 illustrates packer PK set in a build section of a bore hole. One of the conduits defined by the coiled-in-coiled tubing could be used to supply fluid to set the packer, as well as to assist in deflation or unsetting. Packer PK is illustrated as having an inner sleeve through which the tubing CNCT sealingly reciprocates. Analogous packers have been taught and could be adapted to work with coiled tubing.

FIG. 14 illustrates alternate methods for the construction of coiled-in-coiled tubing. For illustrative purposes, FIG. 14 illustrates outer coiled tubing OCT extended essentially horizontally. Inner coil tubing ICT is illustrates as being simultaneously pulled through outer coil OCT by cable CB. Inner coil ICT is also being thrust into outer coil OCT by a coil tubing injector, illustrated schematically as CTI. In addition, inner coil ICT is illustrated as connected at its distal end with a plug PL. Pump P is illustrated as pumping fluid in the annulus between outer coil OCT and inner coil ICT thereby pressuring plug PL to pump inner coil ICT through outer coil OCT.

FIG. 15 illustrates the use of computer control for monitoring and operating complex operations such as alternating testing, treating and testing. Computer CPU is illustrated in electrical connection through line L with the wire line WL that extends through the coiled-in-coiled tubing CNCT and into and through connectors located in the working reel or spool R/S. Computer CPU can collect real time data through wireline communication as well as control downhole tools such as the setting and deflating of packers, the opening and closing of valves, the operating of drills and orienting tools and jetting tools and pumping tools and motors.

EXAMPLE

TEST, TREAT, TEST SYSTEM

The flow testing of oil and gas reservoirs is a critical operation used by operators in both openhole and cased hole applications. The information gained from openhole Drill Stem Tests (DST), permeability, flow rates, skin damage and water production is used to confirm well deliverability and justifies casing the well. Alternately many wells are production tested after being cased to gather additional well information establishing reservoir limits and the presence of wellbore skin damage. In wells with large pay zones (horizontal), production tests are often used to selectively determine the source of well production, hydrocarbon or water, to allow remedial workovers.

Although well testing is common in nearly all reservoirs, the testing of sour gas wells and horizontal wells is still a significant challenge for operators and service companies alike. The testing of sour wells has been very limited due to the concerns of $H_2S$ embrittlement of drillpipe and overall wellsite safety as sour gas is produced to surface. In most cases, without DST data, operators must rely on limited geological and openhole log evaluation to establish well deliverability allowing justification to case the well. In horizontal wells the challenge is to selectively test the horizontal section in the well and use this information to implement remedial stimulation to improve production.

The new technology of the current example uses an inflatable straddle packer tool deployed into vertical or horizontal wells using a "Coil-in-Coil" coiled tubing string configuration. An electrical conductor is located inside the inner string which allows for "real time" formation, evaluation and tool operation. The inner coil string is used for all well flow and stimulation operations, with the coil-in-coil annulus utilized for circulation operations and packer element inflation. More importantly, the outside string also provides for pressure monitoring, flow containment and well control in the unlikely event of a failure of the inner string.

This is in contrast to the testing of wells that has been part of the oil and gas business since the first oil wells were drilled many years ago. Historically, after drilling a well to the target formation, many operators will undertake a flow test of the formation of interest using DST tools run back into the well on the drillpipe. This drillpipe, often empty, is positioned over the zone of interest and then the packer elements are expanded through pipe rotation or setdown weight. A valve in the DST tool is opened allowing formation fluids to enter the evacuated drillpipe, and if adequate bottom hole pressure (BHP) and flow capacity is present, this results in well production to surface. If, however, the BHP is not sufficient, the well will continue to flow into the drillpipe until its hydrostatic pressure equals the reservoir pressure. The tools are then closed and recovered from the well and the produced fluid is measured and analyzed. In the early years of DST use, only well flow data was available. This information, combined with openhole logs, was valuable in the confirmation that well potential was sufficient to warrant casing the well and pursuing a completion. Later advancements in the understanding of well flow and reservoir deliverability resulted in the use of downhole pressure recorders and pressure transient analysis to obtain information on formation permeability, wellbore skin damage and DST tool performance. Some of today's DST tools use data transmission technology to enable the recovery of the pressure drawdown and build-up data during the test, allowing optimization of well flow and buildup durations. The value of the DST data can not be understated as a means of gathering critical well information prior to committing to the cost of casing and completing wells whose deliverability might be marginal.

Unfortunately the development of sour gas and oil formations and the recent growth of horizontal drilling have presented significant challenges for the use of conventional DST tools. Sour wells are presently drill stem tested in very limited applications due to safety concerns and the overall cost. During the testing of a sour well, the drillpipe is exposed to $H_2S$ in the produced oil or gas. Since most drillpipe is made of high tensile strength steel with a Rockwell Hardness in excess of 22Rc, the drillpipe is susceptible to $H_2S$ embrittlement. As a result, most operators will not use the drillpipe for sour flow tests but will stand back or lay down the drillpipe and pick-up a new string of sour service tubing to conduct the DST operation. After the testing operations are completed, the tubing is laid back down and the drillpipe used to either abandon the well or condition the hole for casing operations.

DST data is important in all well evaluations but especially so in the case of carbonate reservoirs since openhole log information may not adequately address the question of well deliverability with the same degree of confidence available on similar logs for sandstone reservoirs. Consequently, the operator is very interested in any additional information on well deliverability, reservoir pressure and wellbore skin damage that will give the operator confidence in the decision to case or abandon the well. The decision to run casing and then subsequently complete the well will cost the operator in the order of CS 400k–600k based on a typical 11,500 foot (3,500 m) sour gas well. However, the decision to abandon the well and bypass a significant find has a more serious impact on future profitability.

Another limitation of current DST tool technology is the ability to quickly evaluate multiple zones in a well and to recover test fluids from each test. In a conventional subhydrostatic DST with drillpipe, formation fluid is recovered into the drillpipe. To analyze this fluid for water, drilling filtrate and hydrocarbon requires the retrieval of the DST tools to surface. In addition, although real-time data transmission is available via Wet-Connect and Electro-Magnetic systems, both have their challenges at present. With the Wet-Connect system, every time one needs to reset the tools across a new pay zone the wire/wet connect needs to be pulled. Once the tools are across the new pay zone, wireline needs to be run in the hole (RIH) to the wet connector and re-establish electrical connection. With the EM system, depth and geology are its main limitations.

Horizontal Wells

Horizontal wells present a similar challenge for existing well testing tools although the requirement is not to obtain data to support a "run casing—don't run casing" decision but to obtain well flow and pressure transient data to allow for maximizing well production and recoverable reserves. Horizontal drilling has developed as a cost effective technology to enhance well production in existing pressure depleted fields or tight low deliverability reservoirs. Unfortunately, although most horizontal wells result in increased well production, both hydrocarbon and water, the operator has limited resources to confirm from where along the extensive openhole section the respective well flows originate.

Many of the most successful horizontal wells are in heterogeneous reservoirs where formation geology varies significantly resulting in bypassed production when using vertical well development. In most horizontal wells, the openhole section is extensive in length with numerous changes in well porosity and permeability along the openhole length. Consequently well deliverability varies considerably both in hydrocarbon and water production. In vertical wells, current openhole and cased hole logging tools can be used to confirm well deliverability based on previous well experience. Unfortunately the use of these same tools in horizontal wells is not as effective. Similarly the use of production logging tools, although successful in vertical wells, is very limited in horizontal wells due to openhole conditions, openhole length, stratified flow, subhydrostatic reservoirs and cost.

The most viable technology presently for use in testing horizontal wells in Canada has been the use of inflatable straddle packers run into the well on jointed tubing and set across a selected area of the openhole. Pressure recorders are located in the BHA and the well is swabbed in to obtain inflow data specific to the test zone after which the well is shut-in at surface for the pressure build-up. The straddle packer assembly is then pulled out of hole (POOH) and the recorded pressure and recovered fluids analyzed to predict wellbore skin and assess production data. If skin is evident, a decision is made to undertake a selective stimulation which would require running back into the well and resetting the packers across the production zone of interest. After stimulation/evaluation process must be repeated multiple times to cover a 3,000 foot (900 m) openhole section. Obviously this procedure is both time consuming, expensive and will produce data of limited quality.

In both sour well development and horizontal well development, there is a need for a downhole tool design and deployment system that will allow for the straddle packer testing of multiple zones, the recovery of reservoir fluid sample without the need to POOH and real-time pressure transient data. The design should also allow for the stimulation or flow modification of the specific evaluation zone based on the real-time evaluation of the flow composition, rate and pressure transient data without having to remove the toolstring.

While the previous discussion reviewed the limitations of current technologies to satisfy the evaluation/stimulation/evaluation requirements of DST's for vertical sweet and sour oil and gas wells and similar service operations for horizontal wells, the following discussion reviews the operational features of the optimum test system and the benefits of these features for actual operations.

For Sour Production Flow Capabilities, the system must be capable of continuous exposure to significant acid gas conditions without concern for axial load conditions. The minimum number of connections and a means of monitoring the condition of the string would be a plus.

For Real-Time Data Recovery And Tool Control, the recovery of data by a real-time system is critical to optimizing both flow and pressure build-up durations as well as optimizing stimulation or flow profile modification treatments. The pressure buildup data must be of sufficient length and sensitivity for pressure transient analysis of wellbore permeability and skin. The optimum system would consist of wireline telemetry (higher data transfer than other present systems) that allowed for continuous surface readouts and downhole tool operation without pipe movement.

For Sample Recovery To Surface, in both vertical and horizontal wells, there is a need to recover bottomhole samples to surface during the test if the well's BHP is inadequate to support continuous flow. In some cases, it would be advantageous if the fluid could be recovered during the test while the well was shut-in at the formation face for build-up.

For Stimulation/Flow Profile Modification Capabilities, in both the horizontal and vertical case, there is benefit to undertake a formation treatment while the tools are still set across the pretested interval. This helps minimize packer resets and enables evaluation during and after the stimulation is complete. Real time read-outs during the treatment would allow one to optimize the treatment. How better to maximize production than to measure a wellbore skin, stimulate to remove the wellbore skin, unload the treatment fluids and then re-evaluate to confirm results all with-in the same test interval and immediate time frame.

For Gas Flow Capabilities, minimum gas flow capability is preferably, although not necessarily, in the order of 2–3 MMCF/day to ensure adequate reservoir drawdown to confirm reasonable gas flow rates at a corresponding formation flowing pressure. In addition the drawdown is required to allow for sufficient pressure build-up data for the pressure transient analysis.

Minimum liquid flow capability is preferably, although not necessarily, in the order 200–300 bbls/day to again ensure adequate reservoir drawdown for deliverability forecasts and pressure build-up analysis.

When drawing down openhole sections with large upset tools, the ability to get stuck is greatly increased. Work history with inflatable packers in openhole DST situations shows that overpulls up to 20,000 pounds (8,900 daN) are sometimes required. The ability to underbalance the inner string slightly so as to "suck" the inflatable packer onto its mandrel would be beneficial since all inflatable packers retain some set after their first inflation. Also the ability to circulate from below to disturb or dissolve debris that might have accumulated on top of the packers while they were set would be advantageous.

Of the 6,000 DST's carried out in Canada during 1995, over 98% were shallower than 11,500 feet (3,500 m).

Straddling the right zone is crucial. Real time gamma and CCL incorporated into the tool suite would alleviate most concerns.

Since no openhole section is ever true, an inflatable element is preferred to allow setting in minor washouts. Since one of the tool's requirements is to test multiple zones quickly, a straddle configuration is required.

The surface equipment is very similar to a conventional coiled tubing wireline logging operation. Basically a standard coiled tubing unit plus one monitoring truck gathers the downhole DST data and operate the downhole electrically actuated valves. The part of the CT surface layout that has been modified is the work reels which have two rotating joints, one for the inner coil and the other for the coil-in-coil annulus, plus one standard wireline collector. This will allow continuous logging (CCL/gamma), the ability to operate downhole valves plus gather pressure and temperature data while RIH/POOH and continuous circulation through either annulus. It will also allow the system to be of a closed loop design so that sour/hydrocarbon based fluids do not need to be purged whenever the tools need to be RIH/POOH.

The Coiled Tubing String Configuration consists of a 2.375" (60.3 mm) exterior coil with an 1.25" (31.8 mm) coil placed inside. Inside the 1.25" coil resides a 3 conductor wireline cable. All sour/corrosive fluids will travel only through the 1.25" while fluid for inflating the packers or gas lifting the well in will be pumped down the coil-in-coil annulus. Pulls and pushes by the injector head will only be subjected to the exterior coil. With this larger size coil, good horizontal reach is achievable, even with a heavy BHA.

The Coiled Tubing—DST Connector, due to the weight (2,000 lbs.), OD (5 ins.) and length (+/−30–90 ft.) of the BHA, will be deployed in a similar manner to a standard DST. After having been hung below the rotary table in a set of slips, the CT injector will be swung over the BHA and connected. This connector has built into it a safety release, should the BRA become stuck while downhole, plus a 3 conductor feed through. Due to the difficulty of rotating either end of the assembly during make-up, it latches in a similar manner to a snap tight.

The heart of the BHA consists of two microprocessors connected through the wireline to a computer at surface. This allows continuous two way communication with the electronic section incorporated in the BHA. The system is capable of full data acquisition as well as complete control of all downhole functions.

Dual inflatable packers provide the ability to isolate discreet segments of the wellbore during flow tests or stimulation/flow profile modification treatments. Inflation of the packers is accomplished by applying pressure through the coil-in-coil annulus. Since this annulus can be circulated to clean fluids (with returns taken up the 1.25"), it eliminates the potential plugging of inflate ports with well debris. It also eliminates the potential of having the inner packer cavity filled with sour, corrosive, hydrocarbon or aromatic fluids. The pressure within the packers, as well as the external wellbore pressure is continuously monitored throughout the operation.

Unlike conventional inflatable packer systems where pressure after a test can only be equalized, these packers can be RIH and POOH in an underbalanced state (less pressure inside than out). This keeps the packers fully collapsed and reduces the potential for encountering wellbore bridges while running into the well or having the packers stuck after deflation due to accumulated debris on top of them. It also reduces the chance of swabbing or surging the well while POOH/RIH.

The minimum bottom hole pressures at which various continuous production rates can be obtained in a 11,500 foot (3,500 m) vertical well through the inner 1.25" string are shown below. In the case of oil, production is aided by nitrogen gas lift with the nitrogen being supplied down the annulus between the inner and outer CT strings.

| Gas Flow Rate (MMscf) | Bottomhole Flow Pressure BHFP (psi) | Wellhead Flow Pressure WHFP (psi) |
|---|---|---|
| 3 | 4450 | 206 |
| 2 | 2965 | 180 |
| 1 | 1520 | 187 |
| **Oil Flow Rate (bpd)** | **BHFP (psi)** | **WHFP (psi)** |
| 300 | 4000 | 160 |
| 200 | 3200 | 170 |
| 100 | 2200 | 220 |

Figure 5A:
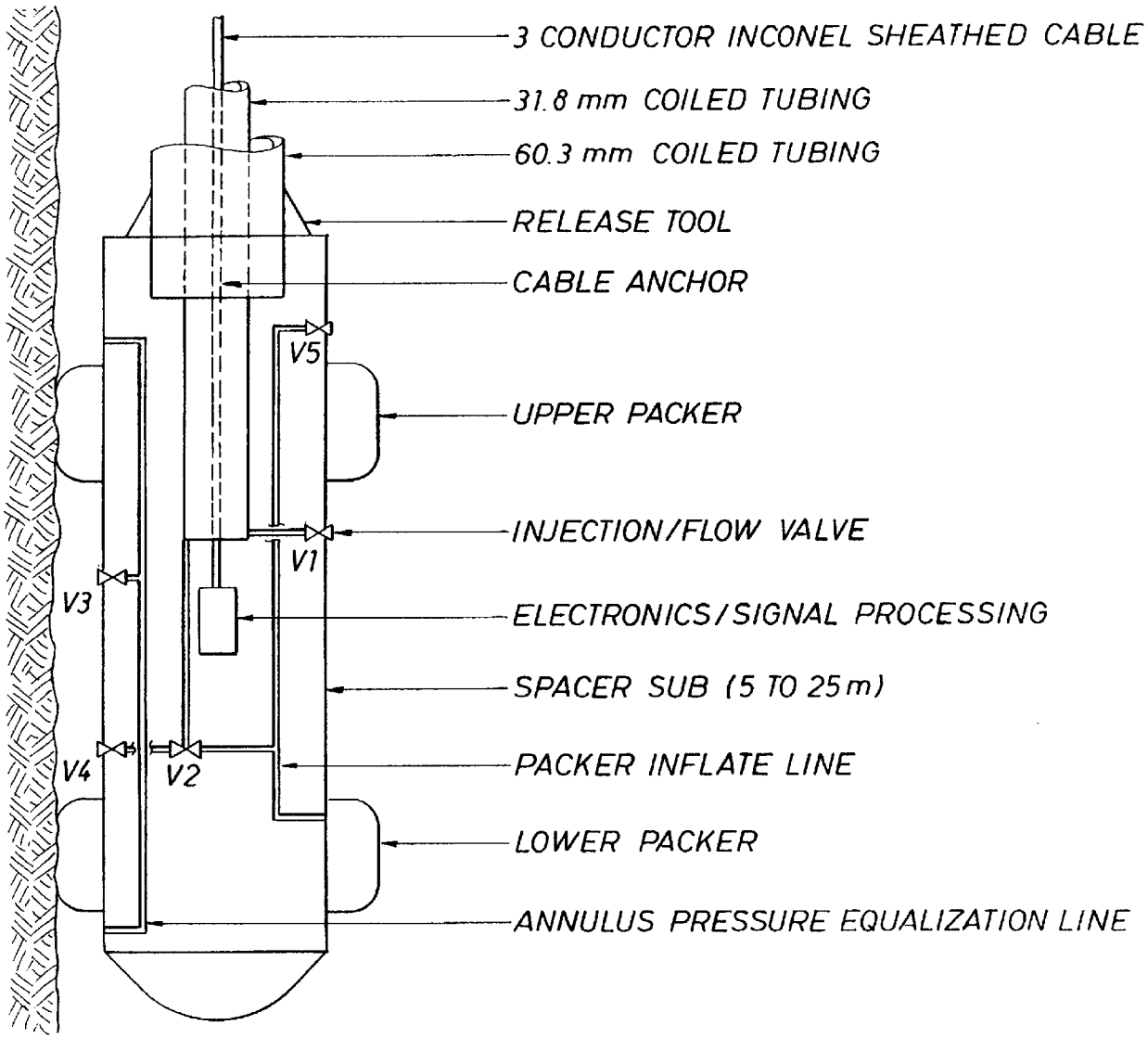

Four (See FIG. 5A) of the downhole fluid control valves are computer controlled, electronically actuated valves, which have been field proven in existing Drill Stem Testing (DST) systems. One is hydraulic. These valves control the flow of fluids between the various components of the system. They are detailed below:

The first valve controls the flow of fluids from the annulus between the straddle packers and the inner coiled tubing string. This "Flow Valve" (VI) normally controls the flow of formation fluids from the well into the inner coil string and is a two position (open/closed) valve. It can also be used to inject fluids from the inner string into the wellbore between the two packers for stimulation, flow profile modification or circulation purposes.

The "Inflation Valve" (V2) is a three position valve which in the "Inflation/Deflation" position allows fluid from the coil-in-coil annulus to be pumped into the packers for inflation purposes or to discharged this pressure at the conclusion of a test. The "Closed" position locks in whatever pressure (negative/positive) that is inside the packers allowing pressure control of the coil-in-coil annulus. In its third position, "Circulation", fluid can be circulated between the inner coil and coil-in-coil annulus in either direction.

The "Equalization Valve" (V3) is a two position (open/closed) valve which allows fluid communication between the three segregated wellbore areas that are created when the two inflate packers are inflated. The one above and below the straddle packers and the one between the two packers. This helps equalize the pressure above and between the packers before deflating them. It also nullifies the chance of fracturing the zone of interest while the packers are still inflating (trapping fluid between the two packers before full expansion has occurred).

The "Injection Valve" (V4) is a two position (open/closed) valve which provides the ability to pump fluids down the coil-in-coil annulus and inject them into the wellbore annular region.

The "Relief Valve" (V5) is a hydraulic, shear pinned valve that protects the packers from over inflation but has a secondary purpose. Namely, should the electronic signal to surface ever fail, the over pressurization of this valve will open it up allowing the packers to deflate.

The following pressures are monitored continuously during all operations at a 5 second sample rate:

Surface:

1. Inner coil (closed chamber or open flow pressure measurements).
2. Outer coil pressure.

Downhole:

1. Outside pressure between the packers (formation pressure), two gauges.
2. Wellbore hydrostatic pressure.
3. Inflation pressure within the packers.
4. Inner coil above the flow valve (recovery pressure).
5. Coil-in-coil annulus pressure.

Downhole temperatures are also recorded continuously. A Gamma Ray and CCL correlation log is incorporated into the tool suite to provide well depth control for critical testing and stimulation operations while RIH/POOH and setting the packers.

One of the primary reasons for the development of this system was safety, particularly in the application of testing sour oil and gas wells. There are a number of safety features which are inherent within the design of this system and address safety. These include:

Pressure and fluid containment barriers are provided by the coil-in-coil system. Continuous monitoring of the outer coil's pressure allows any leak in the inner coil to be detected immediately and testing halted.

Materials of Construction for Equipment: All of the materials used in the fluid handling components of this system are to NACE MR-175 specifications. The coiled tubing is manufactured from an A-606 Type 4, Modified metallurgy which has been used in numerous applications in sour environments over the years. The wireline sheath is made from Incology 825, and the downhole tools from either 4140 carbon steel heat treated to 18–22 Rc or from 17-4PH stainless steel heat treated to H1150÷1150 specifications.

The small volume of the inner coiled tubing string minimizes the amount of sour fluids and hydrocarbons contained in the test string and reduces the risk in well control situations.

Retrieving the test tools with the packers in an underbalanced pressure condition reduces the risk for swabbing the wellbore fluids while pulling out of the well.

If the BRA is stuck and conventional methods can not free it, the BHA can be released by pressurizing up the inner string. If electrical power has also been lost and the valves are in the open position, tension can be applied to the BHA to close a downhole check valve, allowing pressurization.

If electrical power is lost and the packers are still inflated, pressure can be applied down the coil-in-coil annulus to open a deflate port. If the downhole valve is open, an orifice downhole still allows one to generate enough differential pressure to be generated when pumping to open the port.

The procedures to be followed will vary depending on the well configuration and the objectives of the evaluation and/or stimulation program for the well. The following procedures include the most common anticipated situations:

Tripping BHA Into the Well for Well Evaluation

1. Inner string is air or nitrogen filled, depending on well depth.
2. Outer string is partially or fully liquid filled, depending upon BHP.
3. Pressures in each of the two strings may be adjusted while running in the hole.
4. All downhole valves are normally closed while running in the hole.
5. The bypass system in the tools will allow wellbore fluids to circulate through the tool to avoid being forced into the formation by the piston effect, if the clearance between the wellbore and the tool is restricted.
6. The outer string will be slightly underbalanced when compared to the wellbore pressure while RIH to keep the packers fully collapsed and reduce the potential for premature setting when filter cake or tight hole conditions are encountered.

Packer Inflation

1. The packers are inflated by opening the inflation valve and applying pressure to the outer string until the packer inflation pressure is 300–500 psi (2,000–3,500 kPa) above BHP.
2. The inflation valve is then closed, trapping pressure within the packers. Additional pressure can be added at any time by pressurizing the outer string and opening the inflation valve.

Evaluation

The most significant aspect of this coiled tubing delivered system is the flexibility that it provides to the formation evaluation process. It is expected that all operations to be conducted with this technology will commence with an evaluation phase, which will normally consist of at least one flow period and one build up period.

The flow valve, which connects the wellbore to the inner string, is opened electronically to allow produced fluids to flow into the inner string. The volume of the inner string is approximately 11.5 bbls (1.8 $m^3$)

The initial (Preflow) period is usually conducted under closed chamber conditions, providing real time two phase flow rate measurements. Subsequent flow periods may also be conducted under closed chamber conditions when inflow rates are low, or where safety and confidentiality are of major concern.

Pressure and flow rate data can be monitored continuously in the control cab at the wellsite, or remotely at the well operators office.

Interpretation

The value of this technology to well operators is encompassed not only in the quality of the data that is collected, but more importantly, in the ability to interpret and utilize that data instantaneously to maximize operational efficiency.

The essential ingredients for an optimized well test interpretation with the above described system are:

Two phase-flow rate information on a real time basis.

Sample description and analysis prior to the end of the test.

Reservoir parameters from the well operator. Porosity, net pay, fluid saturations, etc.

Personnel on location trained in well test interpretation.

Real time pressure build up data sufficient for radial (direction perpendicular to wellbore) (or other flow regime) analysis.

Flexibility to gas lift to maintain reservoir inflow required.

Well test interpretation software package which provides semi-log and log-log analysis, as well as modeling capabilities and predictions for damage removed productivity.

A communications system between the field and the well operators head office to provide for fast decision making capabilities.

Stimulation/Profile Modification

Treatment fluids will normally be pumped down the inner string with returns taken either up the outer coil/casing annulus or the coil-in-coil annulus. The exhaust/intake ports of these conduits are preferably spaced four and a half feet apart with the inner coil's port just below the upper packer. This provides the ability to spot the treatment fluid directly across the majority of the interval before commencing squeeze operations.

Produced Fluid Circulation

During the final shut in, or after the packers have been deflated, the produced fluids within the inner string can be circulated to surface in order to obtain samples, and to dispose of hydrocarbons and sour fluids. Traditional drill stem testing systems require the use of the wellbore fluid for circulating produced fluids from the test string, which raises well control concerns and restricts circulation operations until after the conclusion of the test. In addition, these systems require that the entire test string be retrieved to surface to reset the circulating valve after it has been opened, since the valve cannot be closed.

The coil-in-coil string plus electronic valve control system provides several benefits with respect to circulation. The circulating valve can be opened and closed an unlimited number of times, allowing circulation of produced fluids after each test during multiple test sequences without tripping out the hole. Fluids from the coil-in-coil annulus are used to circulate produced fluids from the inner string, which allows well control capabilities to be maintained with the wellbore fluid. The outer coiled fluid will be a clean fluid and will provide a better interface to the produced fluids, whereas circulation of wellbore fluids can result in ambiguity since they are sometimes similar to the produced fluids. Circulation can be accomplished during the final shut in period of the test rather than utilizing operational time after the conclusion of the test. It also allows samples to be collected and analyzed several hours sooner.

Packer Deflation

The packers are deflated by opening the inflation valve and allowing pressure to bleed back into the outer string. By using a fluid in the outer string with lower density than the wellbore fluids, the packers can be returned to a slightly underbalanced state after deflation. This reduces the potential for having the tools stuck in the well.

CONCLUSIONS

A new wireline controlled, concentric coiled tubing DST system has been developed for testing, stimulation and profile modification of sour and/or horizontal wells.

The new system has numerous user benefits as outlined above. Namely; safety, sour service rated equipment, circulation control, inflatable elements, multiple sets, test-treat-test and gas lifting capabilities, real-time surface read-out, on-site interpretation and on-line data transmission to head offices.

The real-time capabilities of the system will result in the optimization of rig time. The systems flexibility and inherent safety will also allow for faster turn arounds of these critical operations.

The foregoing disclosure and description of the invention are illustrative and explanatory thereof. Various changes in the size, shape and materials as well as the details of the illustrated construction may be made without departing from the spirit of the invention.

The phrase "well operations" as used below in the claims is intended to refer to, and to include, operations such as treating or forming or testing or measuring and the like, as well as to combinations of the above operations.

What is claimed is:

1. Apparatus for use in well operations, comprising:

coiled-in-coiled tubing, including an inner coiled tubing length within an outer coiled tubing length defining a first inner fluid conduit and a second inner-coil annular fluid conduit;

a bottomhole assembly package adapted to attach to a portion of said tubing such that the assembly is in fluid communication with both said conduits; and at least one packer adapted to be associated with one of said assembly and said tubing.

2. The apparatus of claim 1 wherein said bottomhole package includes at least one tool selected from the group consisting of a production/test tool, a pump tool, a treatment injection tool, a vacuum tool, a jetting tool, a perfing tool, a drilling tool, an orienting tool, a measurement tool, a hydraulic motor and an electric motor.

3. The apparatus of claim 2 wherein said bottomhole assembly includes a pump selected from the group consisting of a jet pump, a chamber list pump and an electric pump.

4. The apparatus of claim 1 wherein said packer includes a straddle packer.

5. The apparatus of claim 1 wherein said at least one packer includes a packer adapted to slidingly attach to the coiled-in-coiled tubing.

6. The apparatus of claim 1 wherein said packer is adapted to be associated with said bottomhole assembly.

7. The apparatus of claim 1 wherein the bottomhole assembly package includes means for testing, treating and retesting.

8. Apparatus for use in well operations, comprising:

coiled-in-coiled tubing, including an inner coiled tubing length within an outer coiled tubing length defining a first inner fluid conduit and a second inter-coil annular fluid conduit; and a bottom-hole assembly package adapted to attach to a portion of said tubing such that the assembly is in fluid communication with both said conduits;

wherein said bottomhole assembly package includes at least two tools selected from the group consisting of a drilling tool, a producing/testing tool, a vacuuming tool, a treatment injection tool, a pumping tool, a perfing tool, and orienting tool, an electric motor, a hydraulic motor, a jetting tool and a measuring tool.

9. The apparatus of claims 1 or 8 including a surface control mechanism for controlling fluid communication within said first and said second conduits.

10. The apparatus of claims 1 or 8 wherein the minimum OD of the inner coil is 1 inch and the minimum OD of the outer coil is 2 inches.

11. The apparatus of claims 1 or 8 that includes a wireline extending through one of said two conduits to establish electrical communication between the surface and the bottomhole assembly package.

12. The apparatus of claim 11 wherein said wireline comprises at least one conductor within a braided line.

13. The apparatus of claim 11 wherein said coiled-in-coiled tubing is coaxial and said wireline is located in said annular conduit.

14. The apparatus of claims 1 or 8 that includes means for communicating data from said assembly package through said wellbore.

15. The apparatus of claim 14 wherein said bottomhole assembly package includes at least one measuring tool connected to said communication means.

16. The apparatus of claim 15 wherein said measuring tool includes at least one instrument from the group consisting of a temperature measuring instrument, a pressure measuring device, a resistively measuring device, a gamma ray logging tool, a sonic logging tool, a neutron logging tool, a logging tool assembly, a flow meter, a densitometer, a chemical analyzer unit, a casing collar locator, and a downhole fluid measuring and analysis unit.

17. The apparatus of claim 14 wherein said communication means comprises coaxial cable or fiber optic cable.

18. The apparatus of claim 14 wherein the means for communicating data includes means for communicating data in real time.

19. The apparatus of claims 1 or 8 wherein said bottomhole assembly package includes a variable spacing unit.

20. The apparatus of claims 1 or 8 wherein the bottomhole assembly is adapted to attach to an end portion of said tubing.

21. The apparatus of claims 1 or 8 that includes a reel/spool and wherein the coiled-in-coiled tubing is at least partially spooled upon said reel/spool.

22. A method for performing well operations, comprising:

connecting coiled-in-coiled tubing to a bottomhole assembly package such that a first inner fluid conduit and a second inter-coil annular fluid conduit, defined by inner and outer coiled tubing lengths, are in fluid communication with said assembly;

locating said bottomhole assembly down a wellbore;

packing off between a portion of the combination of coiled-in-coiled tubing and bottomhole assembly and a portion of the wellbore wall; and communicating fluid through at least one of said conduits to said assembly package.

23. The method of claim 22 that includes producing wellbore fluid up a conduit.

24. The method of claim 22 that includes circulating fluid down a conduit into the wellbore.

25. The method of claim 24 wherein said circulating fluid down includes circulating a treatment fluid.

26. The method of claim 22 wherein said packing off includes setting a packer using hydraulic fluid circulated down one of said conduits.

27. The method of claim 22 wherein said packing off includes packing off between said coiled-in-coiled tubing and a portion of said wellbore wall such that the coiled-in-coiled tubing is sealingly, slidingly received through said packer.

28. The method of claim 22 that includes producing wellbore fluids up one of said conduits followed by circulating a treating fluid down one of said conduits followed by producing wellbore fluids up one of said conduits.

29. The method of claim 22 that includes circulating a treating fluid down one of said conduits followed by producing wellbore fluids up one of said conduits followed by circulating a treating fluid down one of said conduits.

30. The method of claim 22 wherein said packing off includes isolating a portion of said wellbore between a pair of packers.

31. The method of claim 30 that includes circulating fluids down one conduit and up the other conduit to flush out fluids in the isolated zone.

32. The method of claim 22 that includes using fluid communicated through one conduit to hydraulically operate a tool attached to the bottomhole assembly package.

33. A method for performing well operations, comprising:

connecting coiled-in-coiled tubing to a bottomhole assembly package such that a first inner fluid conduit and a second inter-coil annular fluid conduit, defined by inner and outer coiled tubing lengths, are in fluid communication with said assembly package;

locating said bottomhole assembly down a wellbore; and pumping fluid down both conduits to at least a portion of said bottomhole assembly, each fluid comprising either a hydraulic operating fluid for a tool associated with the assembly package or a well treatment fluid.

34. The method of claim 33 wherein the fluid pumped down each conduit comprises a different chemical and wherein the chemicals are selected to produce a chemical reaction when mixed in the wellbore.

35. The method of claim 33 wherein said pumping fluid down includes circulating a fluid from each one of said conduits to a hydraulically operated tool.

36. A method for performing well operations, comprising:

connecting coiled-in-coiled tubing to a bottomhole assembly package such that a first inner fluid conduit and a second inter-coil annular fluid conduit, defined by inner and outer coiled tubing lengths, are in fluid communication with said assembly package;

locating said bottomhole assembly down a wellbore;

circulating fluid down one conduit and up the other conduit; and powering a rotating tool downhole with a portion of said circulated fluid.

37. A method for performing well operations, comprising:

connecting coiled-in-coiled tubing to a bottomhole assembly package such that a first inner fluid conduit and a second inter-coil annular fluid conduit, defined by inner and outer coiled tubing language, are in fluid communication with said assembly package;

locating said bottomhole assembly down a wellbore;

communicating a fluid between the surface and the borehole through one of said conduits; and maintaining a thermally insulating fluid in the other of said conduits.

38. A method for performing well operations, comprising:

connecting coiled-in-coiled tubing to at least one bottomhole assembly package such that a first inner fluid conduit and a second inter-coil annular fluid conduit, defined by inner and outer coiled tubing lengths, are each in fluid communication with an assembly package;

locating at least one assembly package down a wellbore; and producing fluid up both conduits.

39. The method of claims 22, 33, 36, 37 or 38 wherein said locating includes injecting said coiled-in-coiled tubing from a reel/spool.

40. A method for assembling coiled-in-coiled tubing, comprising:

extending a first length of coiled tubing upon the surface; and inserting by means of a coiled tubing injector a second length of coiled tubing through said first coiled tubing.

41. A method for assembling coiled-in-coiled tubing, comprising:

extending a first length of coiled tubing upon the surface; and pulling a second coiled tubing length through said first coiled tubing length by means of a cable inserted through said first coiled tubing.

42. The method for assembling coiled-in-coiled tubing comprising:

extending a first length of coiled tubing upon the surface; and pumping a second coiled tubing length through the first coiled tubing length.

43. The method of claims 40, 41 or 42 that includes lubricating between the second and the first coiled tubing lengths.

44. Apparatus for use in well operations, comprising:

coiled-in-coiled tubing, including an inner coiled tubing length within an outer coiled tubing length defining a first inner fluid conduit and a second inter-coil annular fluid conduit; and a bottomhole assembly package adapted to attach to a portion of said tubing such that the assembly is in fluid communication with both said conduits;

wherein said bottomhole assembly package includes means for testing, treating and retesting.

* * * * *